US007538491B2

(12) United States Patent
Park et al.

(10) Patent No.: US 7,538,491 B2
(45) Date of Patent: May 26, 2009

(54) PLASMA DISPLAY PANEL HAVING DIFFERENTLY SHAPED TRANSPARENT ELECTRODES

(75) Inventors: Hun Gun Park, Kumi-shi (KR); Jae Hong Lee, Daegu-kwangyeokshi (KR); Seok Dong Kang, Kumi-shi (KR); Tae Su Hwang, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/743,782

(22) Filed: Dec. 24, 2003

(65) Prior Publication Data

US 2004/0135507 A1 Jul. 15, 2004

(30) Foreign Application Priority Data

Dec. 27, 2002 (KR) ..... 10-2002-0084872
Jun. 11, 2003 (KR) ..... 10-2003-0037536

(51) Int. Cl.
*H01J 17/49* (2006.01)

(52) U.S. Cl. ..... 313/582

(58) Field of Classification Search ..... 313/582–587
See application file for complete search history.

(56) References Cited

U.S. PATENT DOCUMENTS

| | | | | |
|---|---|---|---|---|
| 3,975,725 | A * | 8/1976 | Ogle | 345/62 |
| 5,640,068 | A * | 6/1997 | Amemiya | 313/582 |
| 5,825,128 | A * | 10/1998 | Betsui et al. | 313/582 |
| 5,877,734 | A | 3/1999 | Amemiya | 345/60 |
| 6,195,070 | B1 * | 2/2001 | Shinoda et al. | 345/60 |
| 6,348,762 | B1 | 2/2002 | Nunomura et al. | 313/582 |
| 6,424,095 | B1 | 7/2002 | Hirao et al. | 315/169.4 |
| 6,452,333 | B1 | 9/2002 | Torisaki et al. | 313/586 |
| 6,838,825 | B2 | 1/2005 | Shiiki et al. | 313/582 |
| 2002/0021090 | A1 * | 2/2002 | Sano et al. | 313/587 |
| 2002/0063524 | A1 | 5/2002 | Nakamura et al. | 313/582 |
| 2004/0070340 | A1 | 4/2004 | Araki et al. | 313/582 |
| 2004/0135507 | A1 | 7/2004 | Park et al. | 313/582 |

FOREIGN PATENT DOCUMENTS

| | | |
|---|---|---|
| JP | 08-250030 | 9/1996 |
| JP | 11-054047 | 2/1999 |
| JP | 2000-106090 | 4/2000 |
| JP | 2000-294154 | 10/2000 |
| JP | 2001-216903 | 8/2001 |
| JP | 2001-325887 | 11/2001 |
| JP | 2001325887 | 11/2001 |
| JP | 2002-324488 | 11/2002 |
| JP | 2002-324490 | 11/2002 |
| KR | 1020010004091 | 1/2001 |

OTHER PUBLICATIONS

Chinese Office Action dated Jun. 23, 2006.
Japanese Office Action dated Feb. 6, 2007.
Japanese Office Action dated May 13, 2008.
Japanese Office Action dated Sep. 30, 2008.

* cited by examiner

*Primary Examiner*—Toan Ton
*Assistant Examiner*—Hana A Sanei
(74) *Attorney, Agent, or Firm*—Ked & Associates, LLP

(57) ABSTRACT

A plasma display panel is provided which includes a transparent electrode pair spaced by a predetermined gap within a discharge cell. Each electrode in the pair includes a head part having a constant width and/or an expanding part having a width which enlarges as it approaches the center of the discharge cell.

8 Claims, 23 Drawing Sheets

PLASMA DISPLAY PANEL HAVING DIFFERENTLY SHAPED TRANSPARENT ELECTRODES

BACKGROUND OF THE INVENTION

1. Field of the Invention

This invention relates to displays, and more particularly to a plasma display panel that is adaptive for improving brightness as well as reducing power consumption.

2. Background of the Related Art

One type of a plasma display panel (PDP) manufactured in large-dimensions is a flat panel display device. A PDP usually controls a discharge period of each pixel in accordance with digital video data to thereby display a picture.

FIG. 1 shows a related-art three-electrode structure that is driven with an AC voltage. In this structure, each discharge cell is arranged in a matrix and includes an upper plate provided with a sustain electrode pair 14 and 16, an upper dielectric layer 18, and a protective film 20 that are sequentially formed on an upper substrate 10. An address electrode 22, a lower dielectric layer 24, barrier ribs 26 and a phosphorous material layer 28 are sequentially formed on a lower substrate 12. The upper and the lower substrates are spaced in parallel by barrier ribs 24.

Each sustain electrode pair 14 and 16 is comprised of transparent electrodes 14A and 16A having a relatively large width made from a transparent electrode material (e.g., ITO) to transmit a visible light, and metal electrodes 14B and 16B having a relatively small width to compensate for a resistance component of the transparent electrodes 14A and 16A. In this case, the transparent electrodes 14B and 16B of the sustain electrode pair and are opposed to each other and are spaced by a gap of approximately 60 μm to 80 μm.

Such a sustain electrode pair and consists of a scan electrode and a sustain electrode. The scan electrode 14 is mainly supplied with a scan signal for panel scanning. The sustain signal for a discharge sustaining, whereas the sustain electrode 16 is mainly supplied with a sustain signal. Electric charges are accumulated in the upper and lower dielectric layers 18 and 24. The protective film 20 prevents a damage of the upper dielectric layer 18 caused by the sputtering to thereby prolong a life of the PDP as well as to improve the emission efficiency of secondary electrons.

The protective film 20 is usually made from MgO. The address electrode 22 crosses the sustain electrode pair 14 and 16. The address electrode is supplied with a data signal for selecting discharge cells to be displayed. The barrier ribs 26 are formed in parallel to the address electrode to thereby prevent ultraviolet rays generated by the discharge from leaking into adjacent discharge cells. The phosphorous material layer 28 is coated on the surfaces of the lower dielectric layer 24 and the barrier ribs 26 to generate any one of red, green and blue visible lights. The discharge space is filled with an inactive gas for a gas discharge.

The discharge cell of the related-art PDP selects a discharge cell by an opposite discharge between the address electrode 22 and the scan electrode 14, and thereafter sustains the discharge by the surface discharge between the sustain electrode pair 14 and 16. The phosphorous material 28 is radiated by an ultraviolet ray generated upon sustain discharge to thereby emit a visible light into the exterior of the cell. Accordingly, the PDP having such discharge cells displays a picture. In this case, the PDP controls a discharge sustain period, that is, a sustain discharge frequency of the discharge cell, in accordance with video data to thereby implement a gray scale required for image display.

An AC surface-discharge PDP of this type performs time-divisional driving of one frame, which is divided into a plurality of sub-fields, so as to realize gray levels of a picture. A light-emission having a frequency proportional to a weighting value of a video data is made in each sub-field period to thereby express a gray level. For instance, if it is intended to display a picture of 256 gray levels using a 8-bit video data, one frame display interval (i.e., 1/60 second=about 16.7 msec) at each discharge cell 11 is divided into 8 sub-fields SF1 to SF8. Each of the 8 sub-fields SF1 to SF8 again is divided into a reset period, an address period and a sustain period, and the sustain period is given by a weighting value at a ratio of 1:2:4:8, . . . , :128. The reset period is a period for initializing the discharge cell, the address period is a period for generating a selective address discharge in accordance with a logical value of a video data, and the sustain period is a period for sustaining a discharge at the discharge cell having generated the address discharge. The reset period and the address period are identically assigned in each sub-field interval.

If electrode widths of the scan electrode 14 and the sustain electrode 16 are narrowly defined in order to reduce power consumption, then a discharge path upon discharge is shortened to thereby limit an light-emission area. Thus, an emission amount of an ultraviolet ray is reduced and hence brightness is deteriorated. On the other hand, if electrode widths of the scan electrode 14 and the sustain electrode 16 are widely defined in order to increase the brightness of the PDP, then a capacitance value becomes large to thereby increase a discharge current and power consumption.

The related-art PDP has a larger screen than other flat panel displays (FPD) such as 40 inch, 50 inch and 60 inch. Such a large screen forces a voltage drop caused by a length of the electrode to have a relatively large difference between the center portion of the discharge cell and the peripheral portion thereof. Also, since a discharge gas at the interior of the PDP is injected at a lower pressure than atmospheric pressure, a force applied to the center portion of the discharge cell where the upper and lower substrates 10 and 12 are supported only by the barrier ribs 26 is different from a force applied to the peripheral portion of the discharge cell, where the upper and lower substrates 10 and 12 are joined to each other by a sealant (not shown). As a result, the PDP of the related-art has a non-discharge area A as shown in FIG. 2, which differ with the size of the panel.

In this related-art PDP, since a length W1 between opposing faces q-ribs 26, which are located between transparent electrodes 14A and 16A to define a gap of a discharge cell as shown in FIG. 3, becomes large, a black brightness rises. Since voltages applied to the transparent electrodes 14A and 16A arranged in parallel to each other is relatively low in the reset period of the PDP, a probability that electrons in the discharge space may be accelerated into more than an ionized energy is relatively low and hence a excitation of neutral atoms caused by a collision of electrons is not active. Thus, the black brightness affects a contrast ratio due to an emission of a slight light generated in the course of transiting neutral atoms from an exciting state into a ground state at a relatively low electron density. Accordingly, the black brightness has to be reduced if it is intended to enhance contrast ratio.

Furthermore, since gaps between the opposite transparent electrodes 14A and 16A within the discharge cell are equal, a discharge is generated between adjacent discharge cells to thereby cause a cross talk.

In order to reduce power consumption, black brightness, and cross talk, another related-art PDP as shown in FIG. 4 is comprised of a sustain electrode pair 64 and 66 that includes transparent electrodes 64A and 66A provided with a stripe part and a head part. The stripe part has a relatively large width and is made from a transparent material (e.g., ITO) to transmit a visible light. The head part expands from the stripe part into the center of the discharge cell. Metal electrodes 64B and 66B having a relatively small width are provided at the stripe part to compensate for a high resistance component of the stripe part. Barrier ribs 76 divide adjacent discharge cells.

The stripe part of each transparent electrode 64A and 66A is formed in a direction crossing the barrier ribs, and the head part thereof expands from the stripe part into the center of the discharge cell such that it does not overlap with the barrier ribs. Thus, each transparent electrode 64A and 66A is expanded such that a transparent electrode material (i.e., ITO) at the non-discharge area overlapping with the barrier ribs 76 is removed, thereby reducing an amount of a current wasted at the sustain electrode pair 64 and 66. Further, since a transparent electrode material (i.e., ITO) at a portion overlapping with the barrier ribs 76 is removed, the transparent electrodes 64A and 66A take part in a discharge independently for each discharge cell.

In this other related-art PDP, a length of the opposite face between the transparent electrodes 64A and 66A within the discharge cell is reduced, because the head part of each transparent electrode 64A and 66A allows each discharge cell to take such a shape that a portion of each transparent electrode overlapping with the barrier ribs 76 is removed. Accordingly, this other related-art PDP can reduce black brightness to thereby enhance contrast ratio.

However, this other PDP raises a phenomenon that a connection of the transparent electrode materials (i.e., ITO) is broken due to an alien substance C or an air bubble D, as shown in FIG. 5, upon patterning of the transparent electrode material in the fabrication process. This is because the transparent electrodes 64A and 66A are connected to the respective metal electrodes 64B and 66B. Therefore, as a result, a discharge current is not applied to the broken transparent material which results in a non-discharge, thereby causing cell binding as indicated by the black. The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention to provide a plasma display panel that is adaptive for improving brightness as well as reducing power consumption.

Another object of the present invention is to provide a plasma display panel that is adaptive for preventing a cell badness caused by an air bubble and an alien substance in the fabrication process as well as enhancing a contrast ratio.

In order to achieve these and other objects of the invention, a plasma display panel according to one embodiment of the present invention comprises a transparent electrode pair spaced with a predetermined gap therebetween within a discharge cell, wherein said transparent electrode pair includes an expanding part having a width more enlarged as it goes into the center of the discharge cell; and a head part connected to the expanding part and having a width kept constantly.

The plasma display panel further includes a stripe part positioned at each of the discharge cells and connected with the expanding part; and a metal electrode connected to the stripe part The plasma display panel further includes a stripe-shaped barrier rib for dividing said adjacent discharge cells; and an address electrode provided in parallel to the barrier rib and in a direction crossing the transparent electrode pair.

The plasma display panel further includes a neck part provided between the stripe part and the expanding part and having each side rounded. Herein, said stripe part has a larger width than the metal electrode within a range of 20 μm to 60 μm.

The expanding part includes a first side set to a range equal to 50% to 150% of the width of the address electrode; a second side being opposite to the first side and having a larger width than the first side; and an incline plane provided between the first side and the second side. Herein, a width of the second side of the expanding part is larger than that of the first side and smaller than a distance between adjacent barrier ribs.

A distance between each end of the transparent electrode pair is approximately 50% to 95% of the pitch of the discharge cell. A length of the head part is within a range equal to approximately 10% to 90% of a distance from the inner end of the stripe part until the end of the head part.

The plasma display panel further includes a link, being overlapped with the barrier rib, for connecting the head parts of said adjacent discharge cells to each other. Herein, said link is provided to be leaned into the ends of the opposite head parts. The link is formed at a predetermined depth extending from the end of the head part into the expanding part. The predetermined depth is approximately 10 μm to 200 μm.

The barrier rib includes a protrusion protruded from each side thereof into the center of the discharge cell. The protrusion includes an incline plane having the same slope as the incline plane of the expanding part.

The plasma display panel further includes a link, being overlapped with the barrier rib, for connecting the head parts of said adjacent discharge cells to each other. The link is provided to be leaned into the ends of the opposite head parts. The link is formed at a predetermined depth extending from the end of the head part into the expanding part. The said predetermined depth is approximately 10 μm to 200 μm.

A plasma display panel according to another embodiment of the present invention includes a first transparent electrode having a first head part protruded from one side of a discharge cell into the center of the discharge cell; and a second transparent electrode provided with an expanding part having a larger width as it goes from other side thereof within the discharge cell into the center of the discharge cell in such a manner to be spaced by a predetermined gap from the first transparent electrode within the discharge cell, and a second head part connected to the expanding part and having a width kept constantly.

The plasma display panel further includes a stripe part positioned at each of the discharge cells and connected with the first head part and the expanding part; and a metal electrode connected to the stripe part.

The plasma display panel further includes a stripe-shaped barrier rib for dividing said adjacent discharge cells; and an address electrode provided in parallel to the barrier rib and in a direction crossing the first and second transparent electrodes. The stripe part has a larger width than the metal electrode within a range of 20 μm to 60 μm.

The expanding part includes a first side set to a range equal to 50% to 150% of the width of the address electrode; a second side being opposite to the first side and having a larger width than the first side; and an incline plane provided between the first side and the second side. A width of the second side of the expanding part is larger than that of the first side and smaller than a distance between adjacent barrier ribs.

A distance from the outer end of the stripe part until the end of the second head part is approximately 75% of a distance between the outer ends of the opposite stripe parts. A length of the second head part is within a range equal to approximately 10% to 90% of a distance from the inner end of the stripe part until the end of the head part.

The plasma display panel further includes a first link, being overlapped with the barrier rib, for connecting the first head parts of said adjacent discharge cells to each other; and a second link, being overlapped with the barrier rib, for connecting the second head parts of said adjacent discharge cells to each other. Each of the first and second links is provided to be leaned into each end of the first and second opposite head parts. Each of the first and second links is formed at a predetermined depth extending from each end of the first and second head parts into the expanding part. The predetermined depth is approximately 10 μm to 200 μm.

A plasma display panel according to still another embodiment of the present invention comprises a sustain electrode pair including transparent electrodes spaced with a predetermined gap therebetween within a discharge cell, and metal electrodes connected to the transparent electrodes, wherein said transparent electrode includes a neck part connected to the metal electrode in such a manner to be separated between the discharge cells; an expanding part connected to the neck part and having a width more enlarged as it goes into the center of the discharge cell; and a head part connected to the expanding part and having a width kept constantly.

The plasma display panel further includes a barrier rib for dividing said adjacent discharge cells; and an address electrode provided in parallel to the barrier rib and in a direction crossing the sustain electrode pair. The neck part has a larger width than the metal electrode within a range of 20 μm to 60 μm. The expanding part includes a first side set to a range equal to 50% to 150% of the width of the address electrode; a second side being opposite to the first side and having a larger width than the first side; and an incline plane provided between the first side and the second side.

A width of the second side of the expanding part is larger than that of the first side and smaller than a distance between adjacent barrier ribs.

A distance between each end of the transparent electrode pair is approximately 50% to 95% of the pitch of the discharge cell. A length of the head part is within a range equal to approximately 10% to 90% of a distance from the inner end of the stripe part until the end of the head part.

The plasma display panel further includes a link, being overlapped with the barrier rib, for connecting the head parts of said adjacent discharge cells to each other. The link is provided to be leaned into the ends of the opposite head parts. The link is formed at a predetermined depth extending from the end of the head part into the expanding part. The predetermined depth is approximately 10 μm to 200 μm.

The barrier rib includes a stripe part having a stripe shape; and a protrusion protruded from each side of the stripe part into the center of the discharge cell. The protrusion includes an incline plane having the same slope as the incline plane of the expanding part.

A plasma display panel according to still another embodiment of the present invention comprises a transparent electrode pair spaced with a predetermined gap therebetween within a discharge cell, wherein said transparent electrode includes a stripe part; a head part protruded from the stripe part into the center of the discharge cell within the discharge cell; and a link for connecting said adjacent head parts to each other.

The plasma display panel further includes a metal electrode connected to the stripe part; and an address electrode provided in parallel to the barrier rib and in a direction crossing the transparent electrode pair. The link is formed at a predetermined depth extending from the end of the head part into the expanding part to thereby overlap with the barrier rib. The predetermined depth is approximately 10 μm to 200 μm.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
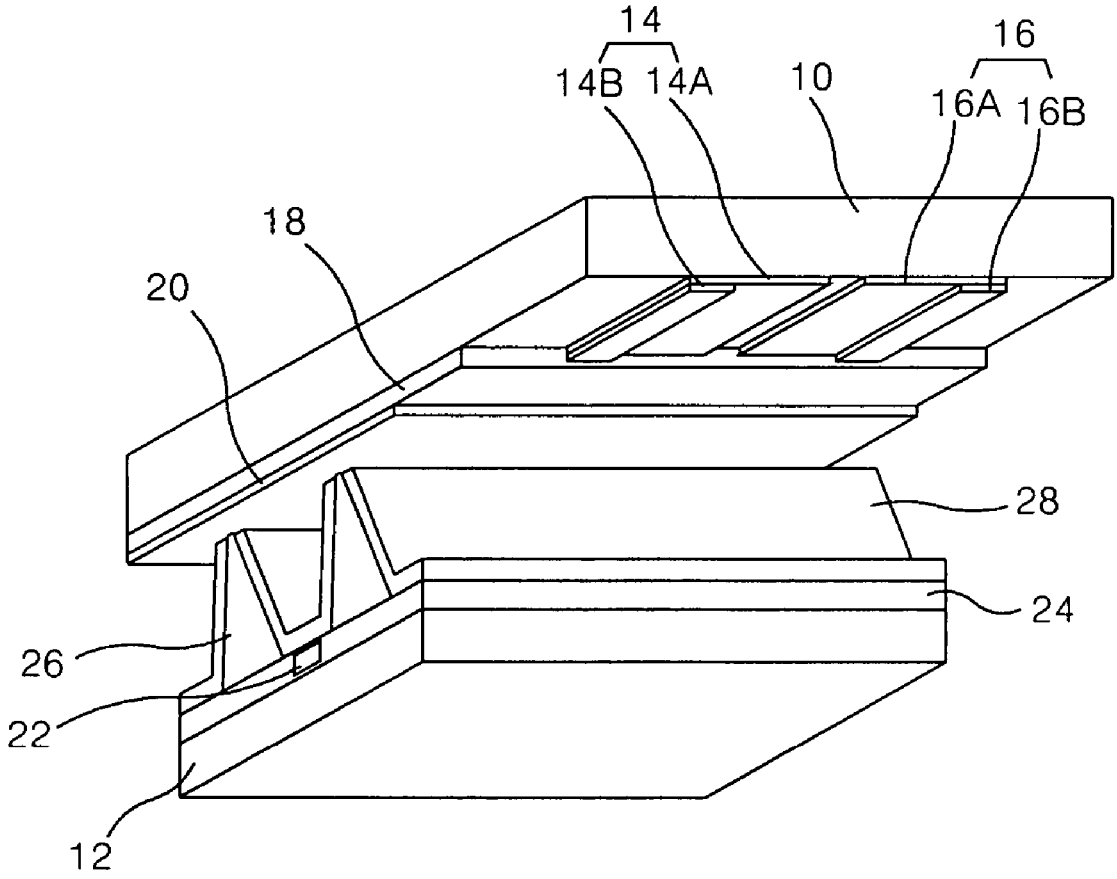
FIG. 1 RELATED ART
FIG. 1 is a perspective view showing a discharge cell structure of one type of related-art plasma display panel.
Figure 2:
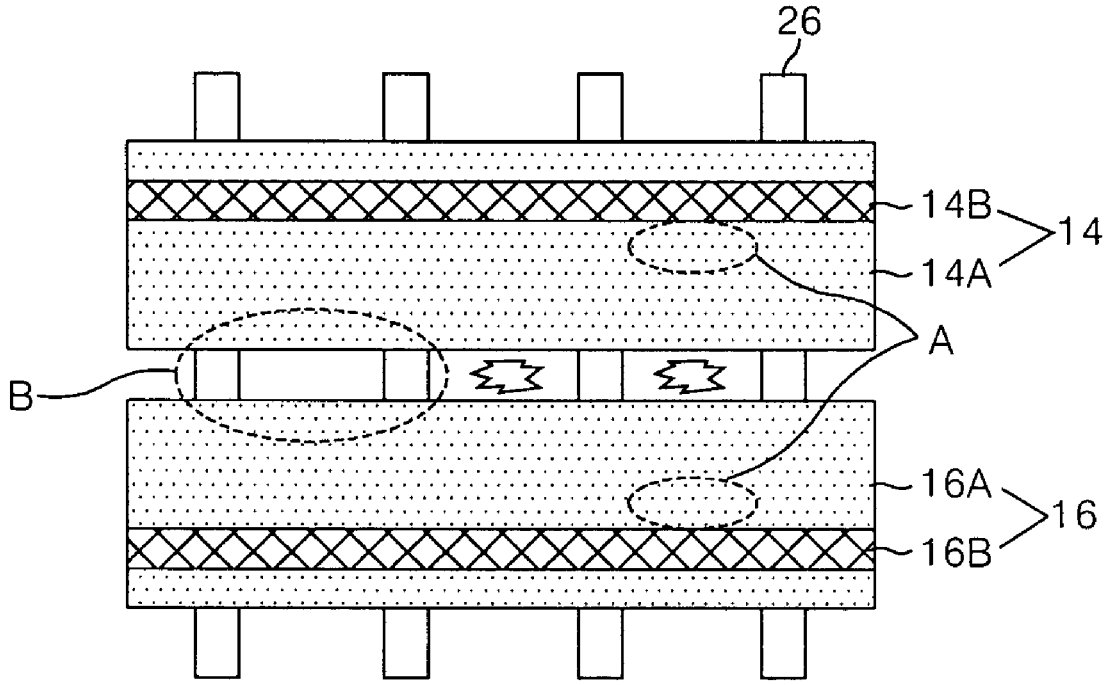
FIG. 2 RELATED ART
FIG. 2 is a plan view showing an electrode structure of the sustain electrode pair in FIG. 1.
Figure 3:
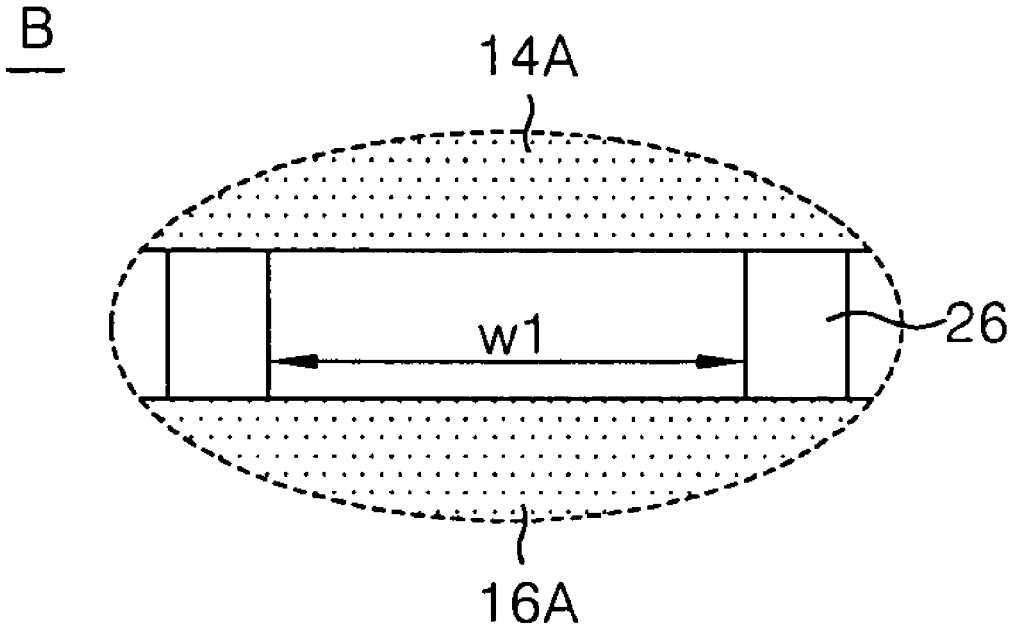
FIG. 3 RELATED ART
FIG. 3 is a plan view representing the B portion in FIG. 2.
Figure 4:
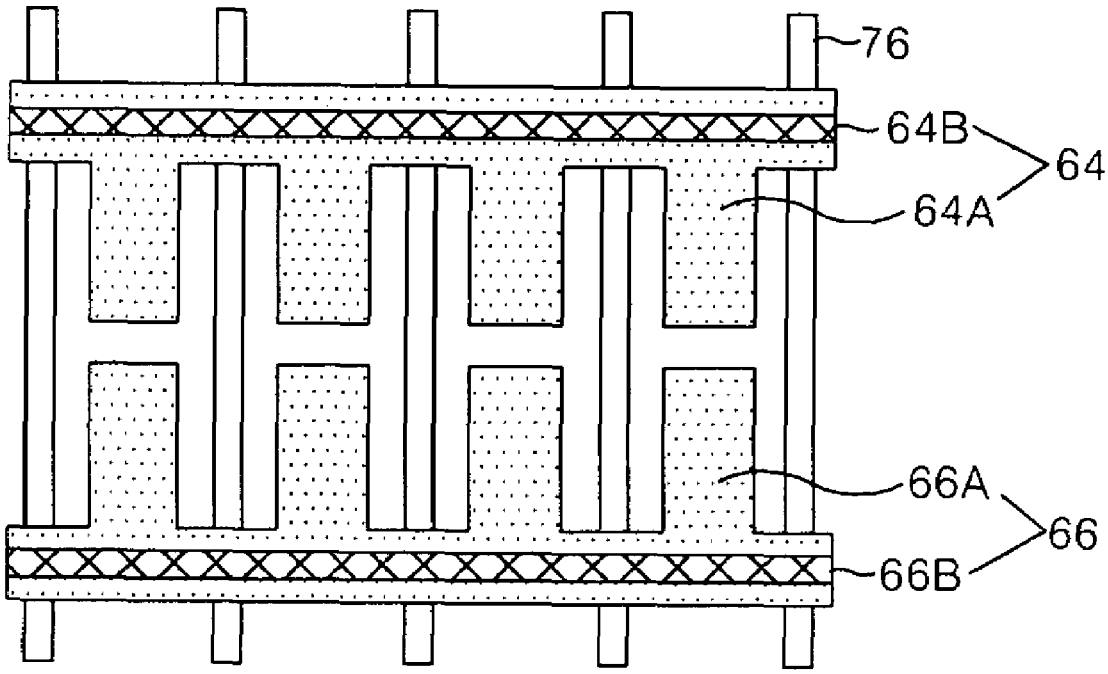
FIG. 4 RELATED ART
FIG. 4 is a plan view showing an electrode structure in another type of related-art plasma display panel.
Figure 5:
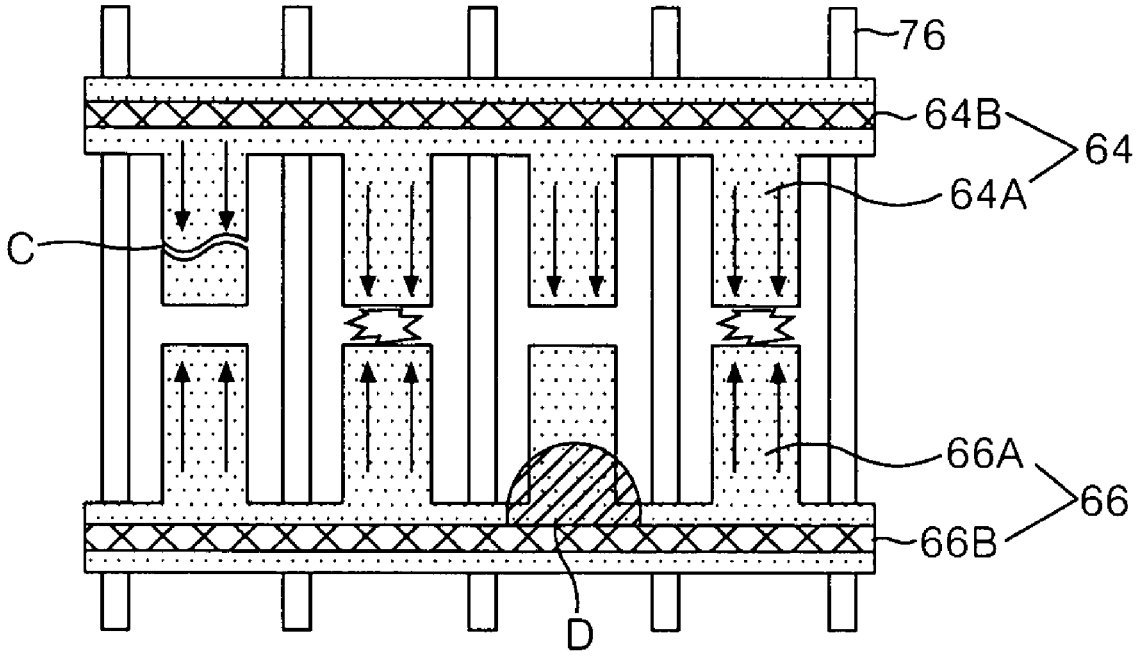
FIG. 5 RELATED ART
FIG. 5 is a plan view showing a discharge cell badness caused by an alien substance and an air bubble upon the electrode formation in FIG. 4.
Figure 6:
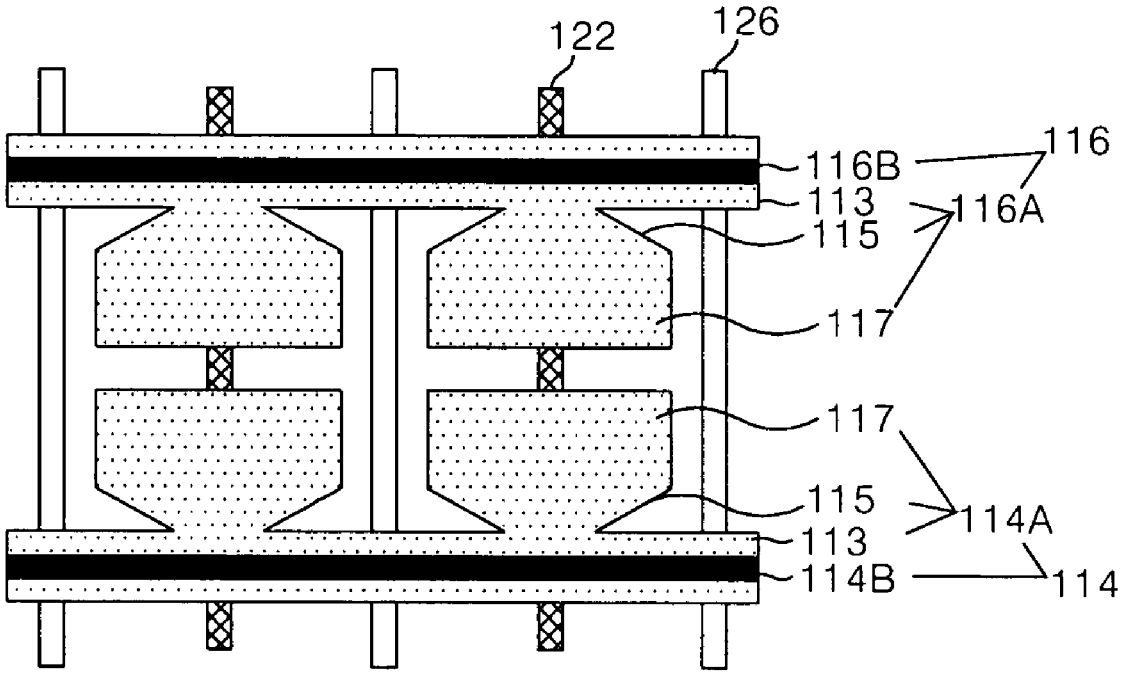
FIG. 6 is a plan view showing an electrode structure in a plasma display panel according to a first embodiment of the present invention.
Figure 7:
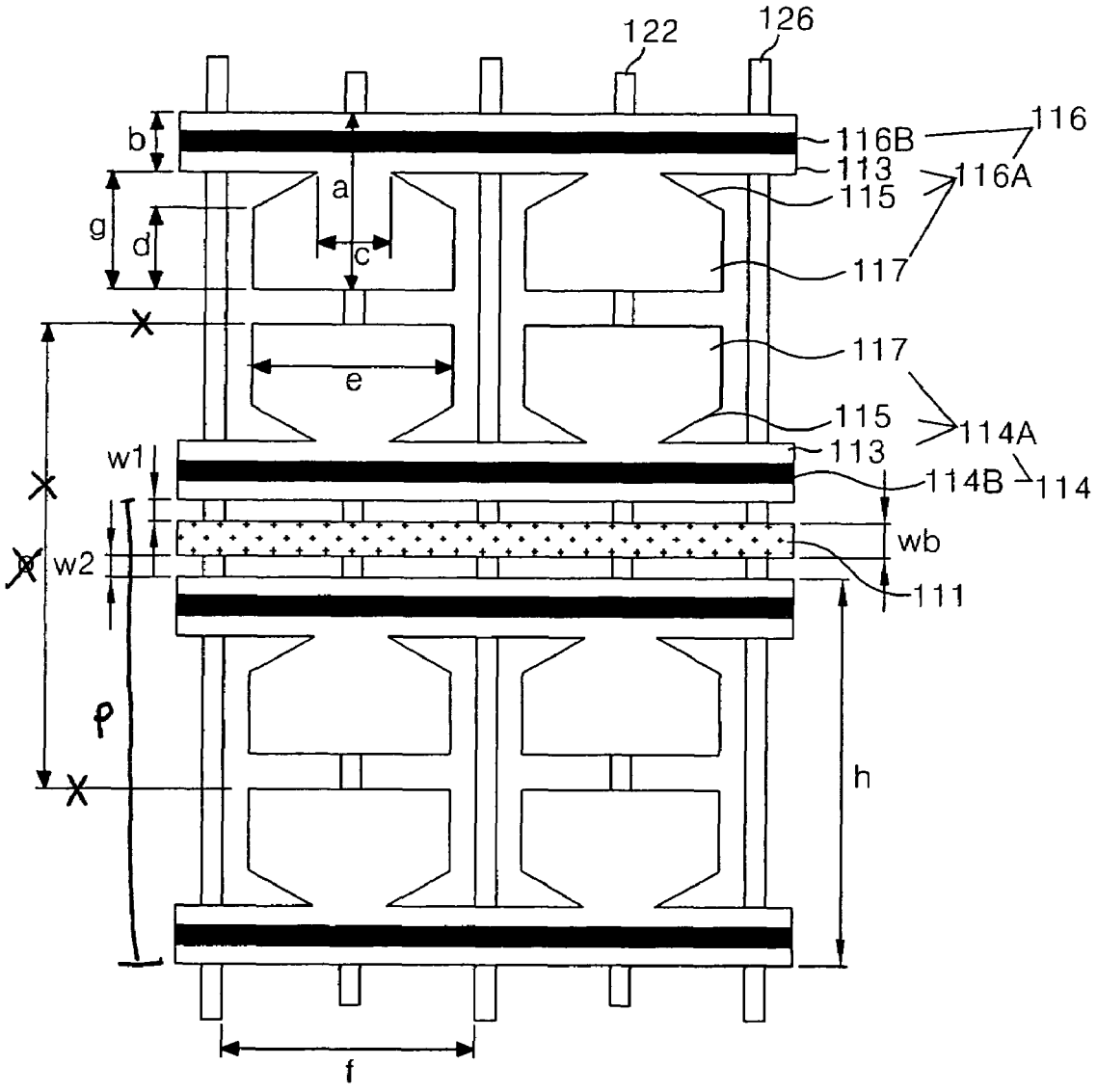
FIG. 7 is a plan view showing an electrode width and length of the transparent electrode in FIG. 6.

Referring to FIGS. 6 and 7, a plasma display panel (PDP) according to a first embodiment of the present invention includes an upper plate and a lower plate. The upper plate is provided with a sustain electrode pair 114 and 116, a black matrix 111, an upper dielectric layer (not shown) and a protective film (not shown) that are sequentially formed on an upper substrate (not shown). The lower plate is provided with an address electrode 122, a lower dielectric layer (not shown), barrier ribs 126 and a phosphorous material layer (not shown) that are sequentially formed on a lower substrate (not shown). The upper and lower substrates are spaced in parallel by barrier ribs 126.

The sustain electrodes 114 and 116 respectively include transparent electrodes 114A and 116A. Each electrode includes a stripe part 113 made from a transparent electrode material (e.g., ITO) to transmit a visible light, an expanding part having a gradually larger width of the transparent electrode material as it goes from the stripe part 113 into the center of the discharge cell, and a head part 117 at which a width of the transparent electrode material expanded by the expanding part is kept. Metal electrodes 114B and 116B are provided at the stripe part 113 at a width smaller than the stripe part 113 to compensate for a resistance component of the transparent electrodes 114A and 116A. In this case, the transparent electrodes 114A and 116A of the sustain electrode pair 114 and 116 are opposed to each other and are spaced by a gap of approximately 50 μm to 100 μm.

Each transparent electrode 114A and 116A improves discharge efficiency and brightness by removing an ineffective electrode portion thereof at which discharge efficiency within the discharge cell is deteriorated, and reduces power consumption by reducing an area of the transparent electrodes.

More specifically, the stripe part 113 of each transparent electrode 114A and 116A are formed from a transparent electrode material (e.g., ITO) having a certain width in a direction crossing the barrier ribs 126. The expanding part 115 of each transparent electrode 114A and 116A has a gradually larger width as it goes into the center of the discharge cell and has the center of the stripe part 113 within the discharge cell therebetween to thereby take a trapezoidal shape. The head part 117 of each transparent electrode has an area expanded into the center of the discharge cell in a state in which an enlarged width of the expanding part 115 is kept as it was to thereby take a rectangular shape.

As shown in FIG. 7, an electrode width b of the stripe part 113 of each transparent electrode 114A and 116A is set to be larger than that of each metal electrode 114B and 116B within a range of 20 μm to 60 μm) in consideration of an alignment tolerance for forming the metal electrodes 114B and 116B.

A distance h between ends of each transparent electrode 114A and 116A is set to be approximately 50% to 95% of a pitch p of the discharge cell. Herein, the pitch p of the discharge cell is equal to a sum of the distance h between both ends of each transparent electrode 114A and 116A including a gap between the transparent electrodes 114A and 116A plus a width wb of the black matrix 111 between adjacent transparent electrodes 114A and 116A plus distances w1 and w2 between the black matrix 111 and the transparent electrodes 114A and 116A.

A sum a of a width b of the stripe part 113 with a width g of the expanding part 115 and the head part 117 is set to a range in which a cross talk between the adjacent discharge cells is not generated at the largest value capable of enlarging the electrode width in consideration of discharge efficiency. A width c of one side having a relatively small width at the expanding part 115 of each transparent electrode 114A and 116A is widely set to be approximately 50% to 150% of the width of the address electrode 122, so as to equalize an address characteristic in consideration of a tolerance with the address electrode 122. A width of the other side having a relatively large width is set to be narrower than a distance f between adjacent barrier ribs 126.

Furthermore, a length d of the head part 117 of each transparent electrode 114A and 116A is set to be approximately 10% to 90% of a length g of the expanding part 115 and the head part 117.

Such a sustain electrode pair 114 and 116 includes a scan electrode and a sustain electrode. The scan electrode 114 is mainly supplied with a scan signal for panel scanning and a sustain signal for discharge sustaining. The sustain electrode 116 is mainly supplied with a sustain signal. Electric charges are accumulated in the upper and lower dielectric layers. The protective film prevents damage of the upper dielectric layer 18 caused by sputtering to thereby prolong a life of the PDP as well as to improve emission efficiency of secondary electrons. This protective film is usually made from MgO.

The address electrode 122 crosses the sustain electrode pair 114 and 116. This address electrode is supplied with a data signal for selecting discharge cells to be displayed. The barrier ribs 126 are formed in parallel to the address electrode 22 to thereby prevent ultraviolet ray generated by the discharge from leaking into adjacent discharge cells. The phosphorous material layer is coated on surfaces of the lower dielectric layer and the barrier ribs 126 to generate any one of red, green and blue visible lights. A discharge space is filled with an inactive gas for a gas discharge.

The PDP according to the first embodiment of the present invention selects a discharge cell by an opposite discharge between the address electrode 122 and the scan electrode 114, and thereafter sustains the discharge by the surface discharge between the sustain electrode pair 114 and 116. The phosphorous material is radiated by an ultraviolet ray generated upon sustain discharge to thereby emit visible light into the exterior of the discharge cell. Accordingly, the PDP displays a picture using these discharge cells. In this case, the PDP controls a discharge sustain period, that is, a sustain discharge frequency of the discharge cell in accordance with video data, to thereby implement a gray scale required for an image display.

The PDP according to the first embodiment of the present invention enlarges an area of each transparent electrode 114A and 116A to raise brightness, and removes the transparent electrode material (i.e., ITO) of the expanding part 115 having a lower discharge efficiency than the center thereof within the discharge cell and the peripheral part overlapping with the barrier ribs 126, thereby reducing power consumption. Accordingly, the PDP according to the first embodiment of the present invention not only improves discharge efficiency and brightness, but also reduces power consumption.

Figure 8:
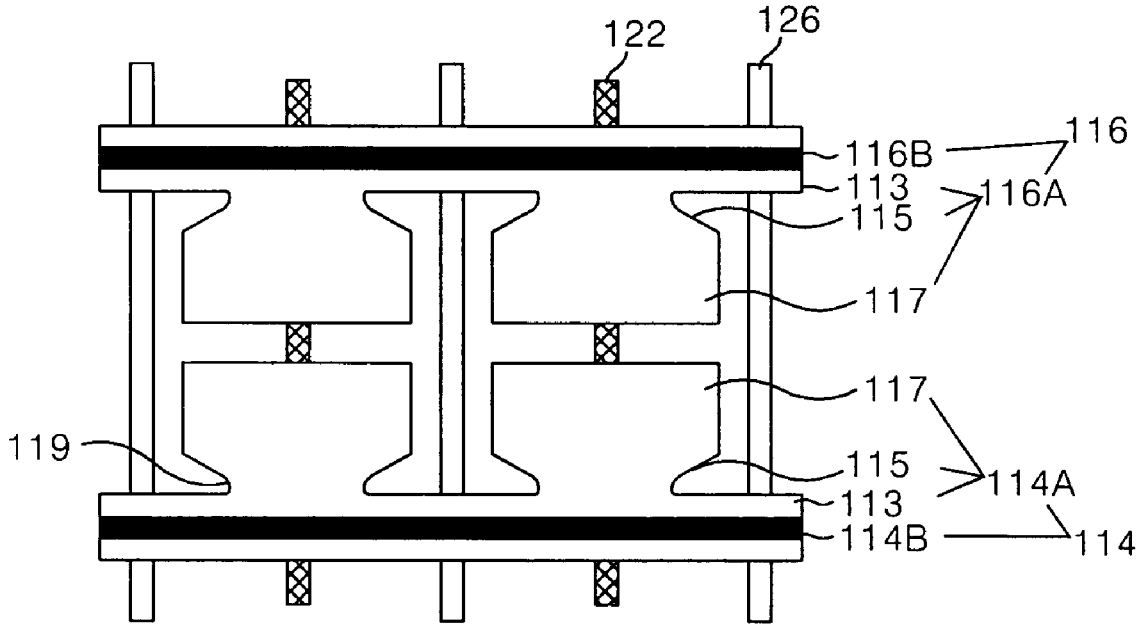
FIG. 8 is a plan view showing a shape of the transparent electrode formed by a process of forming the transparent electrode.

Meanwhile, in the PDP according to the first embodiment of the present invention, when the transparent electrodes 114A and 116A are formed by the well-known technique of using a mask having the same shape as the transparent electrodes 114A and 116A having the stripe part 113, the expanding part 115 and head part 117 shown in FIGS. 6 and 7, a neck part 119 is provided between the stripe part 113 and the expanding part 115 as shown in FIG. 8. In this case, the neck part 119 takes a rounded shape.

Figure 9:
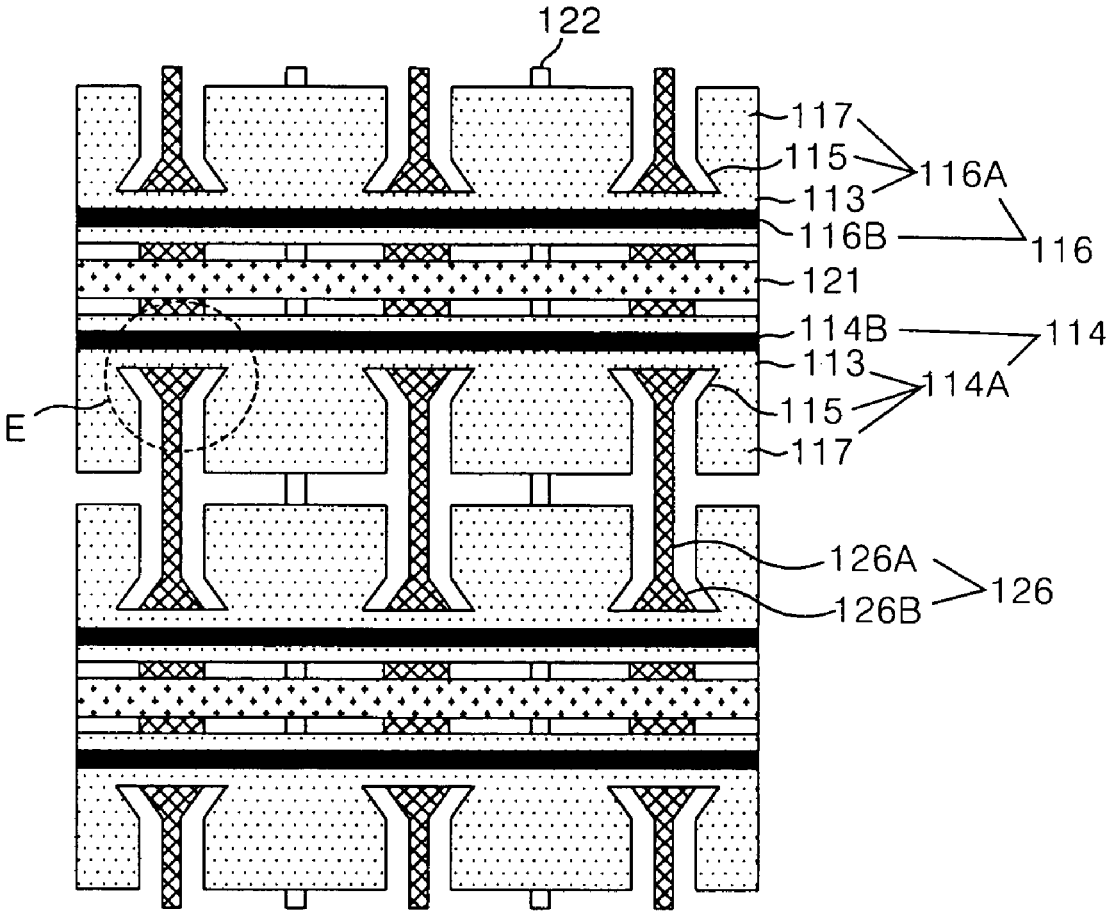
FIG. 9 is a plan view showing an electrode structure in a plasma display panel according to a second embodiment of the present invention.
Figure 10:
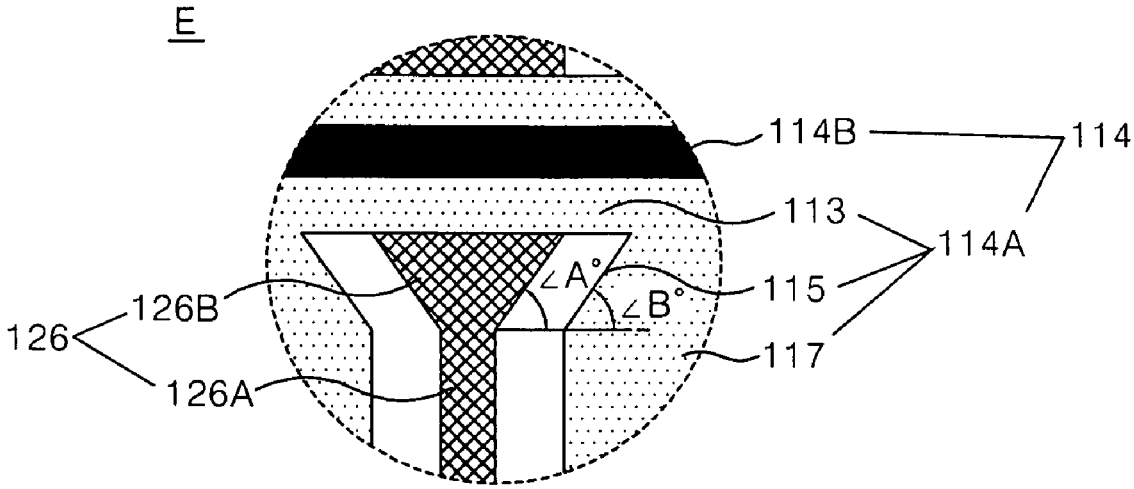
FIG. 10 is a plan view representing the E portion in FIG. 9.

Referring to FIG. 9, a PDP according to a second embodiment of the present invention has the same elements as the first embodiment except for barrier ribs 126. The barrier ribs include a stripe-shaped line 126A, and a protrusion 126B protruding into the center of the discharge cell such that each side surface thereof are symmetrical to each other at a stripe-shaped line 126A. The protrusion 126B protrudes in a trapezoidal shape from the stripe-shaped line 126A to have an incline plane. An angle A° of the incline plane of the protrusion 126B is equal to an angle B° of the incline plane of the expanding part 115 of each transparent electrode 114A and 116A, as shown in FIG. 10. A wing part 126B of the barrier rib 126 is provided at an intersection between the transparent electrodes 114A and 116A and a black matrix 121.

The PDP according to the second embodiment of the present invention provides the transparent electrodes 114A and 116A having the expanding part 115 and head part 117 such that a portion of the transparent electrodes 114A and 116A having a small discharge contribution degree upon discharge between the sustain electrode pair 114 and 116 is removed, thereby reducing power consumption. The PDP according to the second embodiment of the present invention also provides the barrier ribs with the protrusion 126B having a trapezoidal shape, thereby compensating for a brightness reduction caused by the reduction of the transparent electrodes 114A and 116A. Accordingly, the PDP according to the second embodiment of the present invention removes a non-display area within the discharge cell, thereby enhancing discharge efficiency.

The PDP according to the second embodiment of the present invention also allows an angle A° of the incline plane of the trapezoidal protrusion 126B protruded from the barrier rib 126 to be equal to an angle B° of the incline plane of the expanding part 115, thereby improving brightness/efficiency of the panel.

Figure 11:
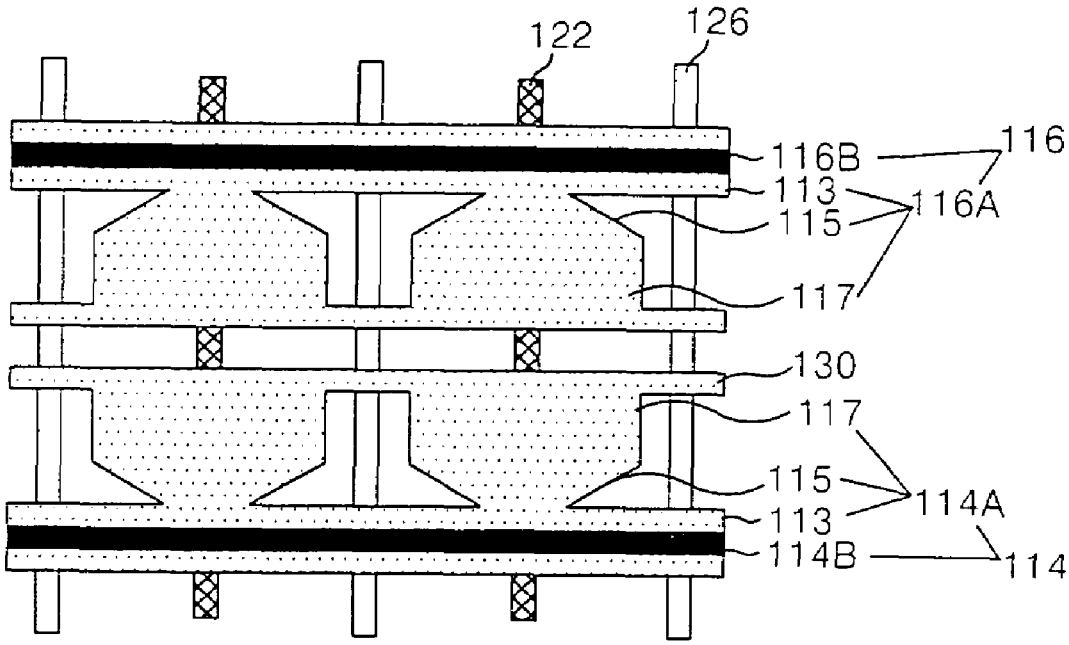
FIG. 11 is a plan view showing an electrode structure in a plasma display panel according to a third embodiment of the present invention.

Referring to FIG. 11, a PDP according to a third embodiment of the present invention includes each element of the first embodiment and in addition a link 130 for connecting transparent electrodes 114A and 116A of a sustain electrode pair 114 and 116 of adjacent discharge cells.

The link 130 overlaps with barrier ribs 126, and is provided so that it leans into ends of opposite head parts 117 of adjacent transparent electrodes 114A and 116A, thereby connecting the head parts of the transparent electrodes of adjacent discharge cells to each other. Such a link forms a path of discharge current through the head parts of adjacent transparent electrodes even though a breakage of a transparent electrode material (i.e., ITO) may occur upon formation of the transparent electrodes. Thus, a discharge current is applied, via the link 130, from the head part 117 of each transparent electrode 114A and 116A of other discharge cell to the transparent electrodes 114A and 116A broken by a cell defect resulting from an alien substance or an air bubble in the course of fabrication of the PDP.

The PDP according to the third embodiment of the present invention thus connects head parts 117 of the transparent electrodes 114A and 116A provided within adjacent two discharge cells, via link 130, to each other, thereby preventing an non-discharge caused by a cell defect occurring in the course of the fabrication process. Furthermore, the PDP has a structure for preventing alignment deviation upon joining of the upper substrate with the lower substrate with the aid of the link.

The PDP according also not only improves discharge efficiency and brightness, but also reduces power consumption, like the PDP according to the first embodiment.

Figure 12:
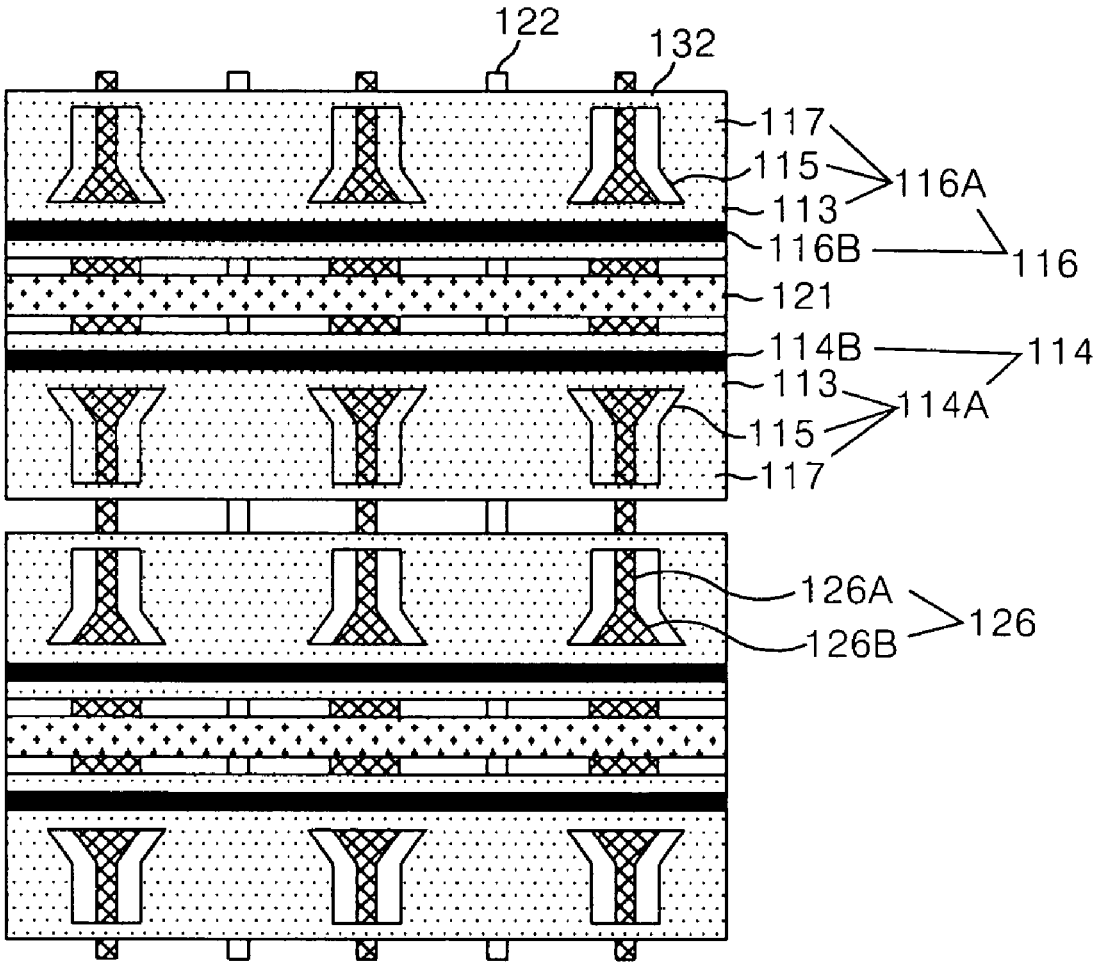
FIG. 12 is a plan view showing an electrode structure in a plasma display panel according to a fourth embodiment of the present invention.

Referring to FIG. 12, a fourth embodiment of the present invention is identical to the third embodiment except for barrier ribs 126. Each barrier rib 126 includes a line 126A having a stripe shape, and a protrusion 126B which protrudes toward the center of the discharge cell such that both sides thereof are symmetrical to each other at the stripe-shaped line 126A. In this case, the protrusion 126B protrudes in a trapezoidal shape from the stripe-shaped line 126A in such a manner as to have an inclined plane. An angle A° of the incline plane of the protrusion 126B is preferably equal to an angle B° of the incline plane of the expanding part 115 of each transparent electrode 114A and 116A as shown in FIG. 10. The protrusion 126B of the barrier rib 126 is provided at an intersection between the transparent electrodes 114A and 116A and a black matrix 121.

In the PDP according to the fourth embodiment, a portion of the transparent electrodes 114A and 116A has a small discharge contribution degree upon discharge between the sustain electrode pair 114 and 116. This reduces power consumption as well as smoothly applies a discharge current through the transparent electrode material (i.e., ITO) of the expanding part 115 having the incline plane. Furthermore, each barrier rib 126 is provided with a protrusion 126B having a trapezoidal shape. This compensates for brightness reduction caused by reduction of the transparent electrodes 114A and 116A.

The PDP according to the fourth embodiment also removes a non-display area within the discharge cell, which thereby enhances discharge efficiency. In addition, the PDP allows an angle A° of the incline plane of the trapezoidal protrusion 126B protruded from the barrier rib 126 to be equal to an angle B° of the incline plane of the expanding part 115, thereby improving brightness/efficiency of the panel.

The PDP also connects the transparent electrodes 114A and 116A provided within adjacent two discharge cells, via the link 132, to each other. This prevents non-discharge caused by a cell defect occurring in the course of the fabrication process. The PDP also has a structure for preventing alignment deviation upon joining of the upper substrate with the lower substrate with the aid of link 132.

The PDP also not only improves discharge efficiency and brightness, but also reduces power consumption, like the PDP according to the first embodiment.

Figure 13:
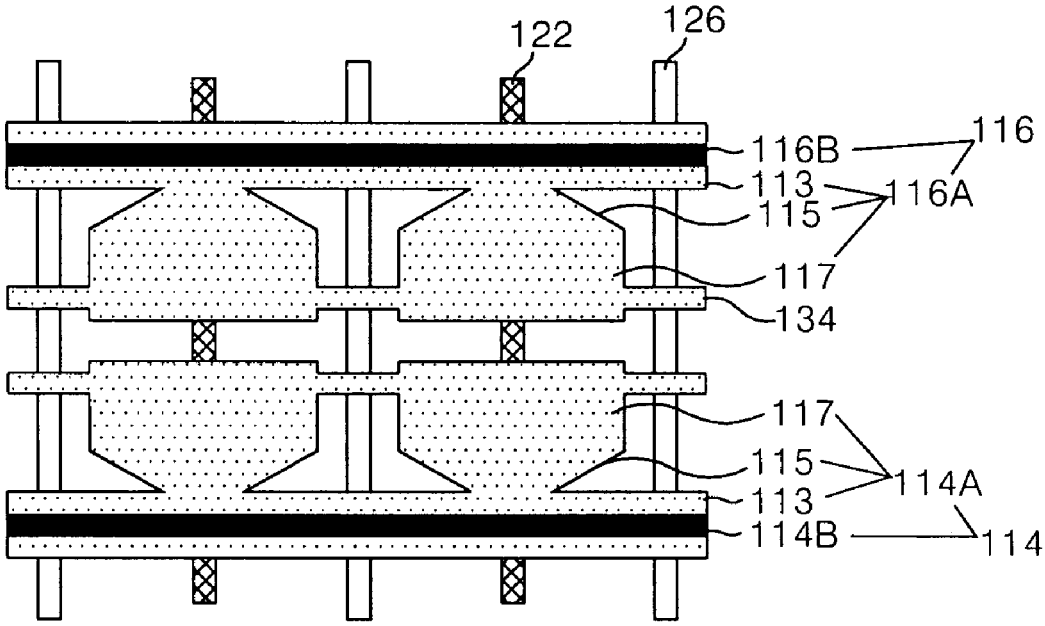
FIG. 13 is a plan view showing an electrode structure in a plasma display panel according to a fifth embodiment of the present invention.

Referring to FIG. 13, a fifth embodiment of the present invention is identical to the third embodiment except for link 134. This link overlaps with barrier ribs 126, and is spaced at approximately 10 μm to 200 μm from the ends of opposite head parts 117 of adjacent transparent electrodes 114A and 116A, thereby connecting the transparent electrodes 114A and 116A of adjacent discharge cells to each other. Such a link 134 forms a path of discharge current through the head parts 117 of adjacent transparent electrodes 114A and 116A even if a breakage of a transparent electrode material (i.e., ITO) occurs upon formation of the transparent electrodes 114A and 116A. Thus, a discharge current is applied, via the link 134, from each transparent electrode 114A and 116A of other discharge cell to the transparent electrodes 114A and 116A broken by a cell defect resulting from an alien substance or an air bubble in the course of fabrication of the PDP.

Accordingly, the PDP according to the fifth embodiment of the present invention connects the transparent electrodes 114A and 116A provided within adjacent two discharge cells, via the link 134, to each other, thereby preventing a non-discharge caused by a cell defect occurring in the course of fabrication. The PDP also has a structure for preventing alignment deviation upon joining of the upper substrate with the lower substrate with the aid of the link 134. Moreover, in the PDP, a length of the opposite face of the head part 117 is reduced due to link 134 leaning into a predetermined inner side at the end of the head part 117 of each transparent electrode 114A and 116A. As a result, contrast ratio is enhanced.

Since voltages applied to the transparent electrodes 14A and 16A arranged in parallel to each other is relatively low in the reset period of the PDP, a probability that electrons existing in the discharge space may be accelerated into more than an ionized energy is relatively low and hence a excitation of neutral atoms caused by a collision of electrons is not active. Thus, the black brightness affects contrast ratio due to an emission of a slight light generated in the course of transiting neutral atoms from an exciting state into a ground state at a relatively low electron density.

Also, in the PDP according to the fifth embodiment, a gap between the opposite head parts 117 within the discharge cell is different from that between adjacent discharge cells due to link 134 leaning into a predetermined depth of inner side from the end of the head part 117 of each transparent electrode 114A and 116A. As a result, discharge between adjacent discharge cells can be prevented and hence a crosstalk can be prevented.

The PDP according to the fifth embodiment also not only improves discharge efficiency and brightness, it also reduces power consumption, like the PDP according to the first embodiment.

Figure 14:
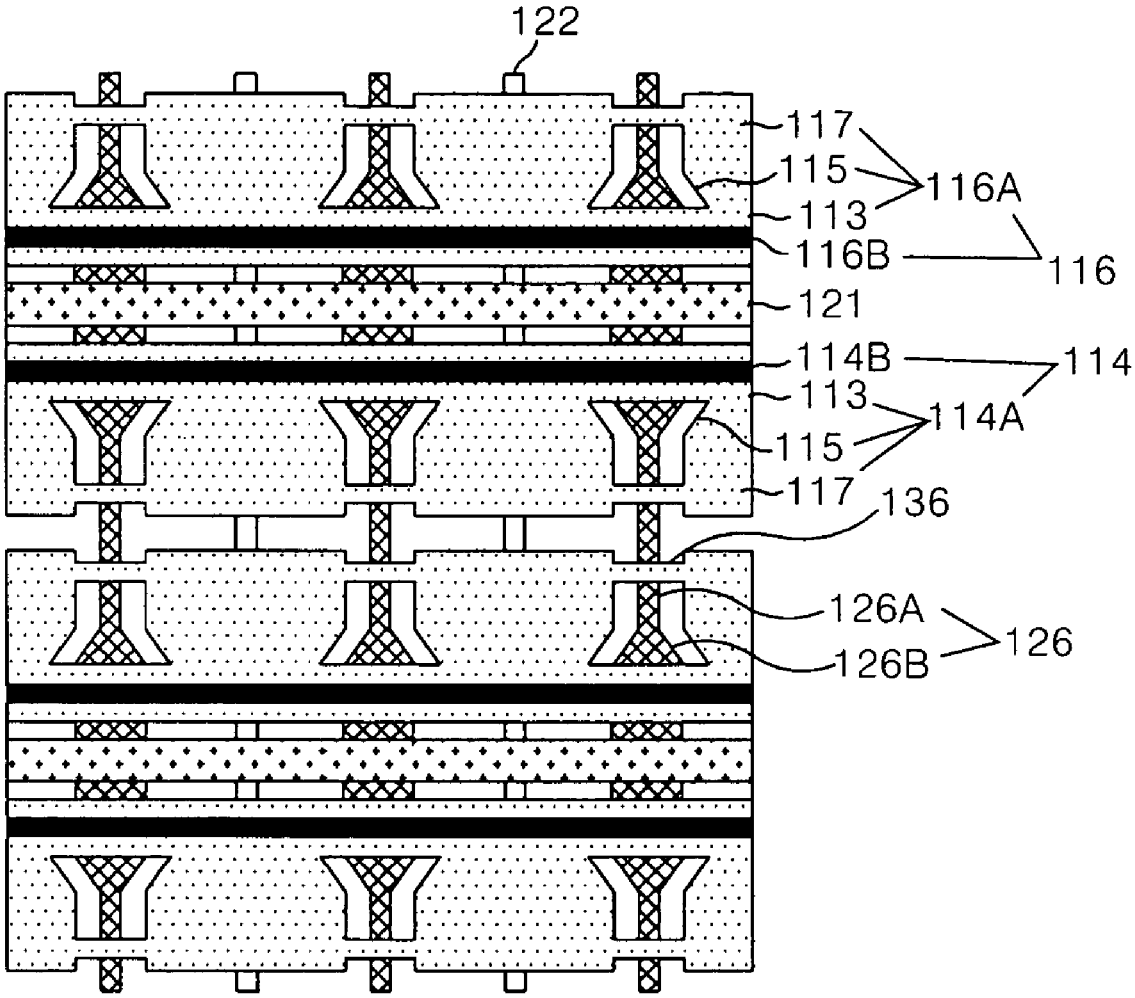
FIG. 14 is a plan view showing an electrode structure in a plasma display panel according to a sixth embodiment of the present invention.

Referring to FIG. 14, a sixth embodiment of the present invention are identical to those in the fourth embodiment except for the link 136. This link overlaps with barrier ribs 126 and is provided to be spaced at approximately 10 μm to 200 μm from the ends of opposite head parts 117 of adjacent transparent electrodes 114A and 116A into a stripe part 113, thereby connecting the transparent electrodes 114A and 116A of adjacent discharge cells to each other. Such a link 136 therefore forms a path of discharge current through the head parts 117 of adjacent transparent electrodes 114A and 116A, even though a breakage of a transparent electrode material (i.e., ITO) may occur upon formation of the transparent electrodes 114A and 116A. Thus, discharge current is applied, via the link 136, from each transparent electrode 114A and 116A of other discharge cell to the transparent electrodes 114A and 116A broken by a cell defect resulting from an alien substance or an air bubble in the course of a fabrication process of the PDP.

The PDP according to the sixth embodiment of the present invention thus connects the transparent electrodes 114A and 116A provided within adjacent two discharge cells, via the link 136, to each other, to thereby prevent non-discharge caused by a cell defect occurring in the course of fabrication. The PDP has a structure for preventing an alignment deviation upon joining of the upper substrate with the lower substrate with the aid of the link 136. Moreover, in the PDP according to the sixth embodiment, a length of the opposite face of head part 117 is reduced due to link 136 leaning into a predetermined inner side at the end of the head part 117 of each transparent electrode 114A and 116A. As a result, black brightness is reduced to thereby enhance contrast ratio.

Also, in the PDP according to the sixth embodiment, a gap between the opposite head parts 117 within the discharge cell is different from that between adjacent discharge cells due to link 136 leaning into a predetermined inner side from the end of the head part 117 of each transparent electrode 114A and 116A. As a result, discharge between adjacent discharge cells can be prevented and hence a crosstalk can be prevented.

The PDP according to the sixth embodiment also not only improves discharge efficiency and brightness, but it also reduces power consumption, like the PDP according to the first embodiment.

Figure 15:
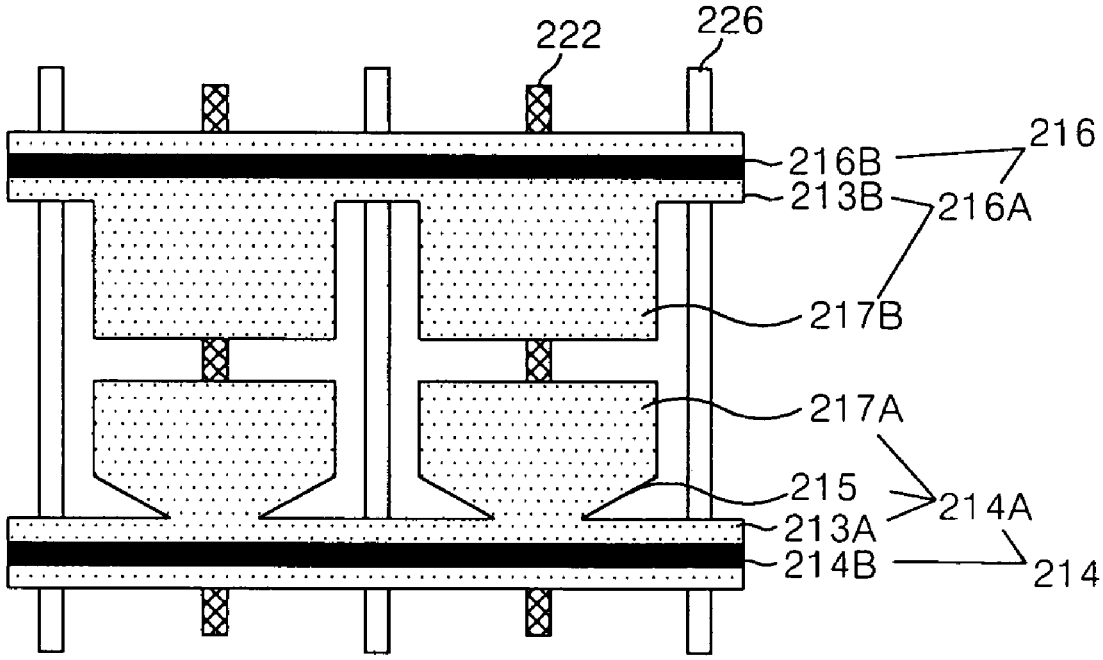
FIG. 15 is a plan view showing an electrode structure in a plasma display panel according to a seventh embodiment of the present invention.

Referring to FIG. 15, a PDP according to a seventh embodiment of the present invention except for sustain electrode pair 214 and 216. Each of the sustain electrode 214 and 216 includes a first transparent electrode 214A having a first stripe part 213A formed from a transparent electrode material (i.e., ITO) to transmit a visible light, an expanding part 215 having a width gradually enlarged from the first stripe part 213A, and a first head part 217A at which the enlarged width of the expanding part 215 is kept. A second transparent electrode 216A includes a second stripe part 213B formed from a transparent electrode material (i.e., ITO) to transmit a visible light, and a second head part 217B expanded at the same width as the first head part 217A from the second stripe part 213B. Metal electrodes 214B and 216B are provided on the respective first and second stripe parts 213A and 213B of the first and second transparent electrodes 214A and 216A to compensate for resistance components of the first and second transparent electrodes 214A and 216A. The first and second transparent electrodes 214A and 216A of the sustain electrode pair 214 and 216 are opposed to each other and have a gap of approximately 50 μm to 100 μm.

Since the first transparent electrode 214 of the sustain electrode pair 214 and 216 has the same structure as the transparent electrode of the PDP according to the first embodiment of the present invention shown in FIG. 6, an explanation as to this will be replaced by the description of the PDP according to the first embodiment of the present invention.

The PDP according to the seventh embodiment of the present invention enlarges the electrode area of any one of the transparent electrodes 214A and 216*a* of the sustain electrode pair 214 and 216 to thereby raise the brightness. Also, transparent electrode materials (i.e., ITO) at the expanding part 215 are removed to have a more reduced discharge efficiency than the center thereof within the discharge cell and the peripheral part overlapping with the barrier ribs 226. This reduces power consumption. Accordingly, the PDP of the seventh embodiment not only improves discharge efficiency and brightness, but it also reduces power consumption.

Figure 16:
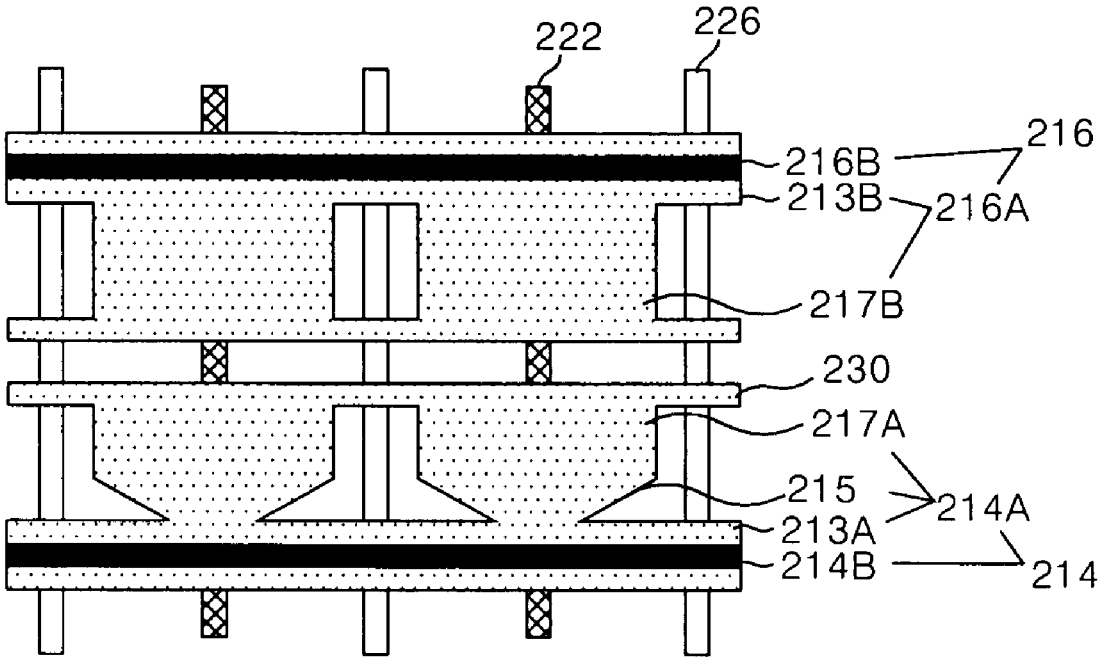
FIG. 16 is a plan view showing an electrode structure in a plasma display panel according to an eighth embodiment of the present invention.

Referring to FIG. 16, an eighth embodiment of the present invention are identical to those in the seventh embodiment except for link 230. This link overlaps with barrier ribs 226 and leans into ends of opposite first head parts 217A of adjacent first transparent electrodes 214A, thereby connecting the first head parts 217A of the first transparent electrodes 214A of adjacent discharge cells to each other. Link 230 also leans into ends of second head parts 217B of adjacent second transparent electrodes 216A, thereby connecting the second head parts 217B of the second transparent electrodes 214B to each other.

Link 230 therefore forms a path of discharge current through the head parts 217A and 217B of adjacent transparent electrodes 214A and 216A, even though breakage of a transparent electrode material (i.e., ITO) may occur upon formation of the transparent electrodes 214A and 216A. Thus, a discharge current is applied, via the link 230, from each transparent electrode 214A and 216A of other discharge cell to the transparent electrodes 214A and 216A broken by a cell defect resulting from an alien substance or an air bubble in the course of fabrication of the PDP.

The PDP according to the eighth embodiment thus connects the transparent electrodes 214A and 216A provided within adjacent two discharge cells, via the link 230, to each other, to thereby prevent non-discharge caused by a cell defect occurring in the course of the fabrication process. The PDP also has a structure for preventing alignment deviation upon joining of the upper substrate with the lower substrate with the aid of link 230.

Figure 17:
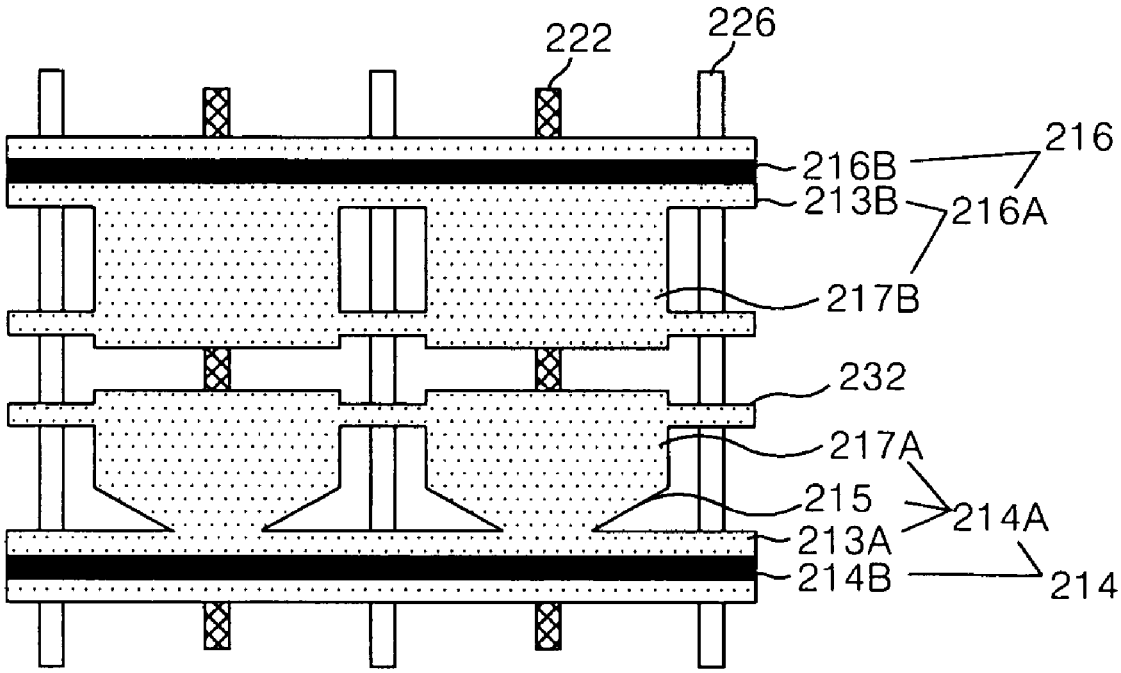
FIG. 17 is a plan view showing an electrode structure in a plasma display panel according to a ninth embodiment of the present invention.

Referring to FIG. 17, a ninth embodiment of the present invention is identical to the seventh embodiment except for link 232. This link overlaps with barrier ribs 226, and is provided to be spaced at approximately 10 μm to 200 μm from the ends of first head parts 217A of adjacent first transparent electrodes 214A into a first stripe part 213A, thereby connecting the first head parts 217A of the first transparent electrodes 214A of adjacent discharge cells to each other. Link 232 also overlaps with barrier ribs 226, and is provided to be spaced at approximately 10 μm to 200 μm from the ends of second head parts 217B of adjacent second transparent electrodes 216A into a second stripe part 213B, thereby connecting the second head parts 217B of the second transparent electrodes 214B of adjacent discharge cells to each other.

Link 232 thus forms a path of discharge current through the head parts 217A and 217B of adjacent transparent electrodes 214A and 216A even though a breakage of a transparent electrode material (i.e., ITO) may occur upon formation of the transparent electrodes 214A and 216A. Thus, a discharge current is applied, via the link 232, from each transparent electrode 214A and 216A of other discharge cell to the transparent electrodes 214A and 216A broken by a cell defect resulting from an alien substance or an air bubble in the course of fabrication of the PDP.

The PDP according to the ninth embodiment therefore connects the transparent electrodes 214A and 216A provided within adjacent two discharge cells, via the link 232, to each other to thereby prevent non-discharge caused by a cell defect occurring in the course of fabrication. The PDP also has a structure to prevent alignment deviation upon joining the upper substrate with the lower substrate with the aid of link 232. Moreover, in the PDP according to the ninth embodiment, lengths of the opposite faces of head parts 217A and 217B are reduced due to link 232 leaning toward the inner side thereof by approximately 10 μm to 200 μm at the ends of the head parts 217A and 217B of each transparent electrode 214A and 216A. As a result, black brightness is reduced to thereby enhance contrast ratio.

Furthermore, in the PDP according to the ninth embodiment, a gap between the opposite head parts 217A and 217B within the discharge cell is different from that between adjacent discharge cells due to link 232 leaning into a predetermined inner side from the ends of the head parts 217A and 217B of each transparent electrode 214A and 216A. As a result, discharge between adjacent discharge cells is prevented and hence crosstalk is prevented. In addition, the PDP not only improves discharge efficiency and brightness, it also reduces power consumption, like the PDP according to the first embodiment.

Figure 18:
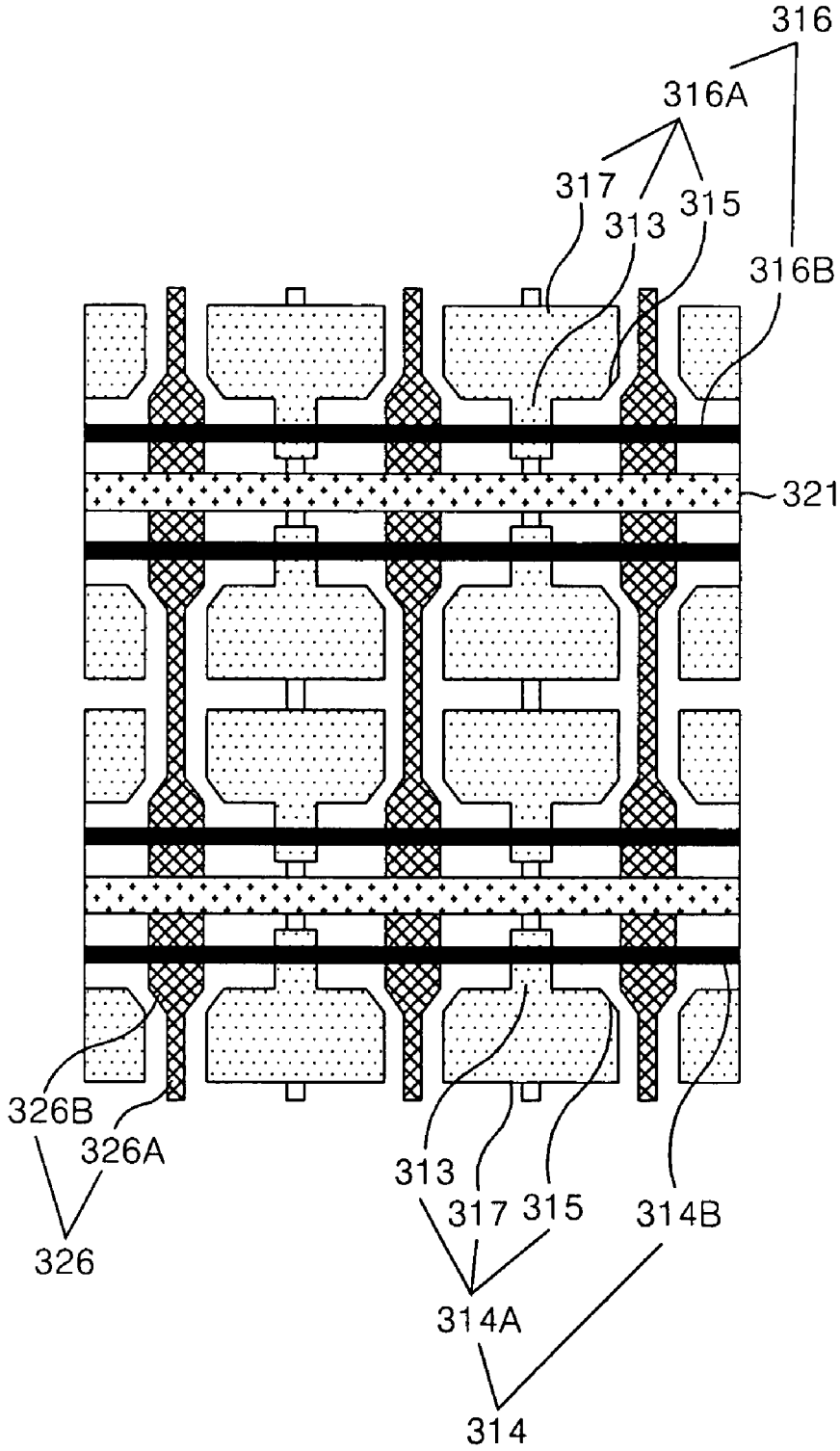
FIG. 18 is a plan view showing an electrode structure in a plasma display panel according to a tenth embodiment of the present invention.

Referring to FIG. 18, a PDP according to a tenth embodiment of the present invention includes a sustain electrode pair 314 and 316 provided with transparent electrodes 314A and 316A taking a short and flat paddle shape, metal electrodes 314B and 316B crossing the transparent electrodes 314A and 316A, and barrier ribs 326 for dividing adjacent discharge cells. Since the PDP according to the tenth embodiment of the present invention has the same elements as the PDP according to the first embodiment of the present invention except for the paddle-shaped transparent electrodes 314A and 316A and the barrier ribs 326, an explanation as to other elements excluding the paddle-shaped transparent electrodes 314A and 316A and the barrier ribs 326 will be omitted.

In the PDP according to the tenth embodiment, each paddle-shaped transparent electrode 314A and 316A includes a square-shaped neck part 313 formed from a transparent electrode material (i.e., ITO) to transmit a visible light. Each electrode is also connected to the metal electrodes 314B and 316B and includes an expanding part 315 having a gradually enlarged width as it goes into the center of the discharge cell with having the center of the neck part 313 therebetween and a head part 317 at which a width enlarged by the expanding part 315 is kept. In this case, the transparent electrodes 314A and 316A of the sustain electrode pair 314 and 316 are opposed to each other and are spaced by a gap of approximately 50 μm to 100 μm.

An ineffective electrode portion having discharge efficiency deteriorated within the discharge cell of each transparent electrode 314A and 316A is removed to thereby enhance discharge efficiency and brightness, and an area of each transparent electrode 314A and 316A is reduced to thereby decrease power consumption.

More specifically, the neck part 313 of each transparent electrode 314A and 316A is connected to the middle areas of the metal electrodes 314B and 316B going through one edge thereof within the discharge cell. The expanding part 315 of each transparent electrode 314A and 316A is connected to the neck part 313 and has a width which gradually increases symmetrically as it goes into the center of the discharge cell, and having the center of the neck part 313 within the discharge cell therebetween, to thereby take a trapezoidal shape.

On the other hand, the head part 317 of each transparent electrode 314A and 316A has an area expanded into the center of the discharge cell in a state in which the enlarged width of the expanding part 315 is kept as it is, to thereby take a rectangular shape. Since the expanding part 315 and head part 317 of each transparent electrode 314A and 316A are identical to those of the transparent electrodes 114A and 116A according to the first embodiment of the present invention shown in FIG. 6, an explanation as to them will be replaced by the description of the PDP according to the first embodiment of the present invention.

In the PDP according to the tenth embodiment of the present invention, the barrier ribs 326 includes a stripe-shaped line 326A, and a protrusion 326B which protrudes into the center of the discharge cell such that each side surface thereof is symmetrical to each other at the stripe-shaped line 326A. In this case, the protrusion 326B protrudes in a trapezoidal shape from the stripe-shaped line 326A to have an inclined plane. An angle A° of the incline plane of the trapezoidal protrusion 326B is preferably equal to an angle B° of the incline plane of the expanding part 315 of each transparent electrode 314A and 316A as shown in FIG. 10. A wing part 326B of the barrier rib 326 is provided at an intersection between the transparent electrodes 114A and 116A and a black matrix 121.

The PDP according to the tenth embodiment provides the transparent electrodes 314A and 316A to have the neck part 313, the expanding part 315 and the head part 317 such that a portion of the transparent electrodes 314A and 316A having a small discharge contribution degree upon discharge between the sustain electrode pair 314 and 316 is removed. Thus reduces power consumption. Furthermore, the PDP according to the tenth embodiment provides the barrier ribs 326 with a protrusion 326B having a trapezoidal shape, which thereby compensates for brightness reduction caused by a reduction of the transparent electrodes 314A and 316A.

The PDP according to the tenth embodiment thus removes a non-display area within the discharge cell, thereby enhancing discharge efficiency. The PDP also allows an angle A° of the incline plane of the trapezoidal protrusion 326B protruding from the barrier rib 326 to be equal to an angle B° of the incline plane of the expanding part 315, thereby improving brightness/efficiency of the panel.

Figure 19:
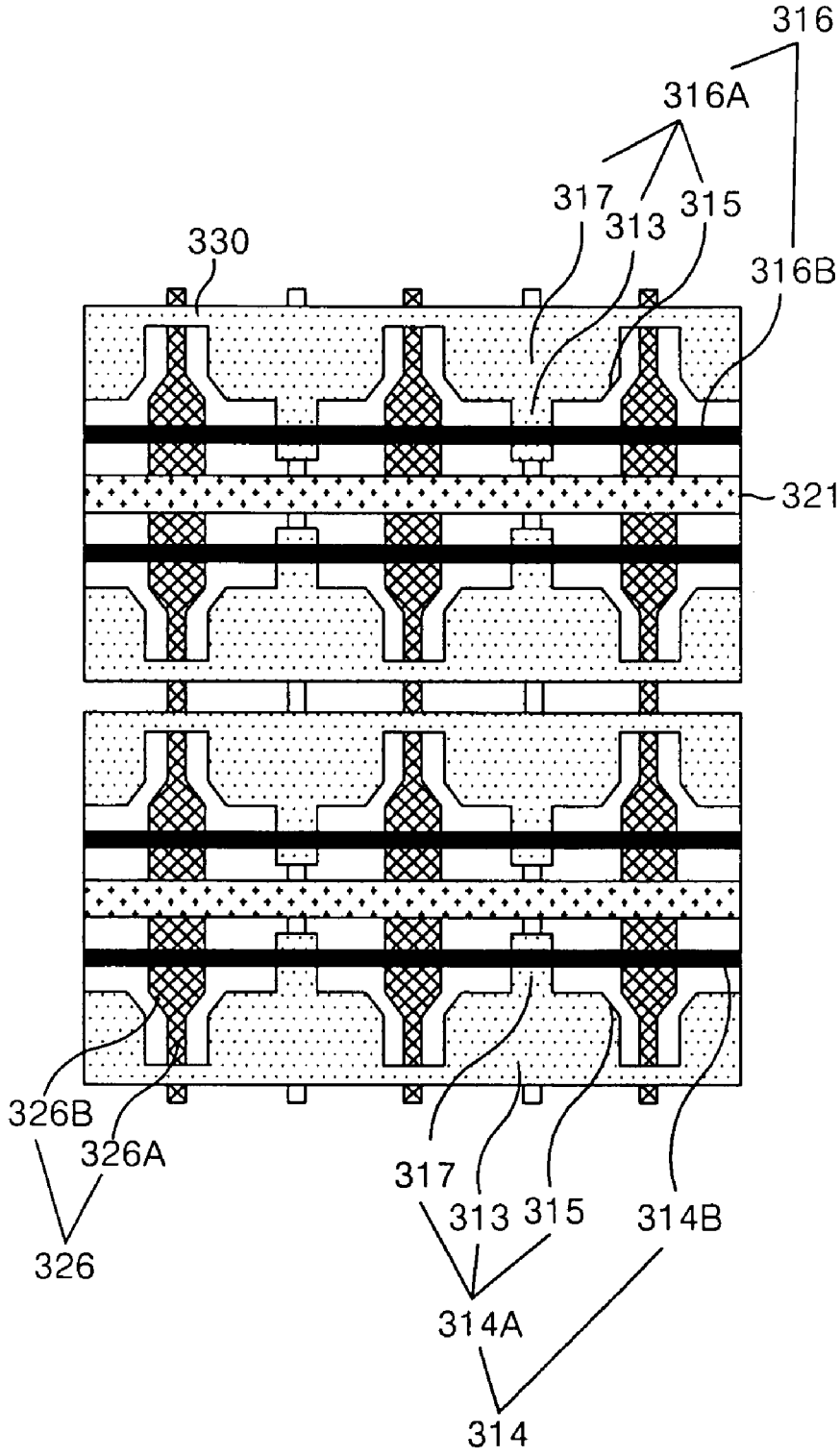
FIG. 19 is a plan view showing an electrode structure in a plasma display panel according to an eleventh embodiment of the present invention.

Referring to FIG. 19, an eleventh embodiment of the present invention are identical to those in the tenth embodiment except for link 330. This link overlaps with barrier ribs 326 and is provided to be leaned into the ends of opposite head parts 317 of adjacent transparent electrodes 314A and 316A, thereby connecting head parts 317 of the transparent electrodes 314A and 316A of adjacent discharge cells to each other. Such a link forms a path of discharge current through the head parts 317 of adjacent transparent electrodes 314A and 316A even though a breakage of a transparent electrode material (i.e., ITO) may occur upon formation of the transparent electrodes 314A and 316A. Thus, discharge current is applied, via the link 330, from the head part 317 of each transparent electrode 314A and 316A of other discharge cell to the transparent electrodes 314A and 316A broken by a cell defect resulting from an alien substance or an air bubble in the course of fabrication of the PDP.

The PDP according to the eleventh embodiment connects head parts 317 of the transparent electrodes 314A and 316A provided within adjacent discharge cells, via the link 330, to each other, to thereby prevent non-discharge caused by a cell defect occurring in the course of fabrication. Furthermore, the PDP according to the eleventh embodiment has a structure for preventing alignment deviation upon joining the upper substrate with the lower substrate with the aid of link 330.

In addition, the PDP not only improves discharge efficiency and brightness, it also reduces power consumption, like the PDP according to the first embodiment.

Figure 20:
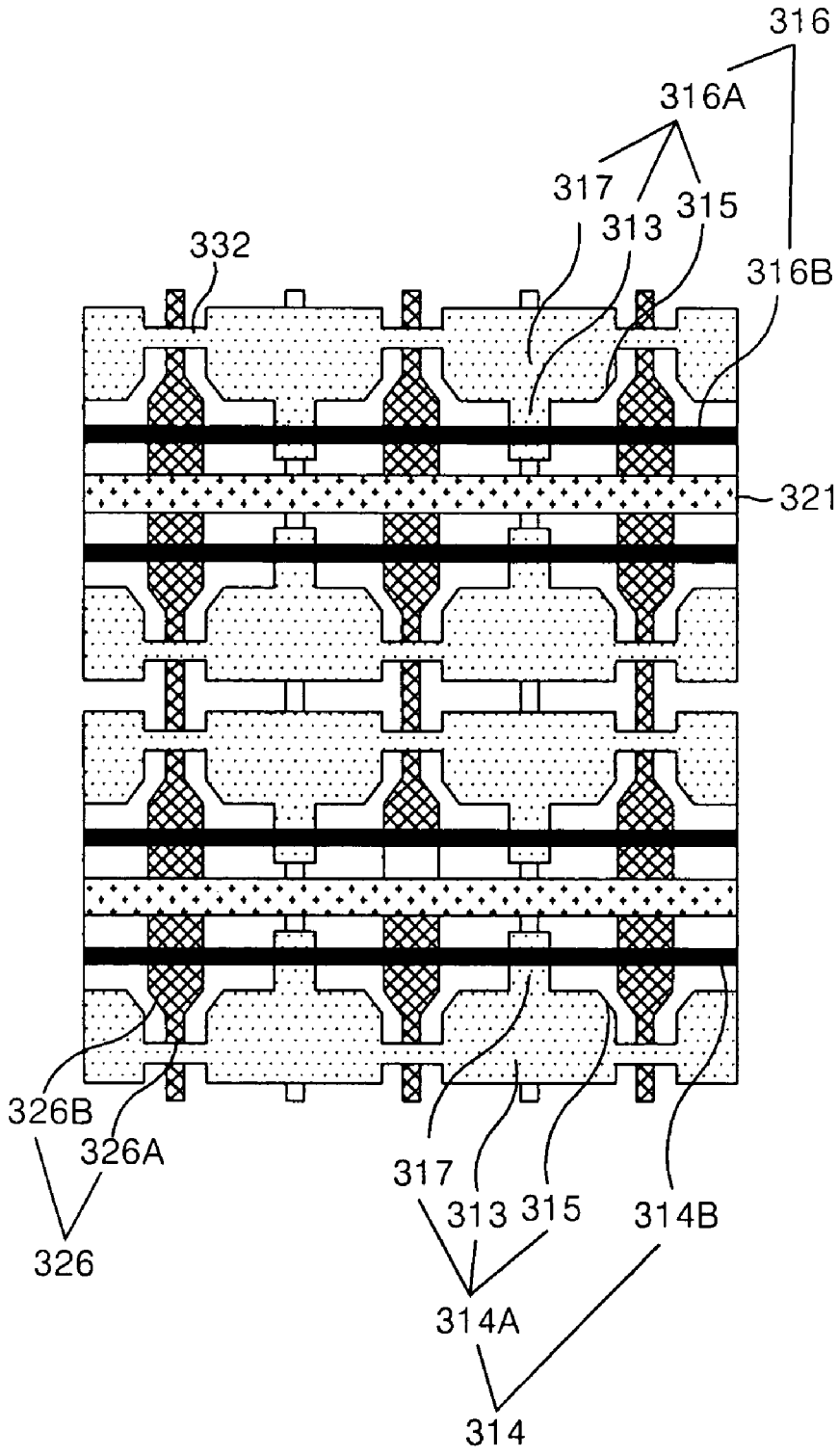
FIG. 20 is a plan view showing an electrode structure in a plasma display panel according to a twelfth embodiment of the present invention.

Referring to FIG. 20, a twelfth embodiment of the present invention are identical to the tenth embodiment except for link 332. This link overlaps with barrier ribs 326 and is provided to be spaced, at approximately 10 μm to 200 μm, from the ends of opposite head parts 317 of adjacent transparent electrodes 314A and 316A into the neck part 313, thereby connecting the head parts 317 of the transparent electrodes 314A and 316A of adjacent discharge cells to each other. Such a link 332 forms a path of discharge current through the head parts 317 of adjacent transparent electrodes 314A and 316A even though a breakage of a transparent electrode material (i.e., ITO) may occur upon formation of the transparent electrodes 314A and 316A. Thus, a discharge current is applied, via the link 332, from the head part 317 of each transparent electrode 314A and 316A of other discharge cell to the transparent electrodes 314A and 316A broken by a cell defect resulting from an alien substance or an air bubble in the course of fabrication of the PDP.

Accordingly, the PDP according to the twelfth embodiment connects the head parts 317 of the transparent electrodes 314A and 316A provided within adjacent two discharge cells, via the link 332, to each other. This prevents non-discharge caused by a cell defect from occurring in the course of fabrication process. Furthermore, the PDP according to the twelfth embodiment has a structure for preventing alignment deviation upon joining the upper substrate with the lower substrate with the aid of link 332. Moreover, in the PDP according to the twelfth embodiment, a length of the opposite face of the head part 317 is reduced due to link 332 leaning into the inner side, by approximately 10 μm to 200 μm, at the end of the head part 317 of each transparent electrode 314A and 316A. As a result, black brightness is reduced and hence contrast ratio can be enhanced.

Furthermore, in the PDP according to the twelfth embodiment, a gap between the opposite head parts 317 within the discharge cell is different from that between adjacent discharge cells due to link 332 leaning into a predetermined inner side from the end of the head part 317 of each transparent electrode 314A and 316A, so that a discharge between adjacent discharge cells can be prevented and hence cross talk can be prevented.

The PDP according to the twelfth embodiment thus cannot only improve discharge efficiency and brightness, but also reduces power consumption, like the PDP according to the first embodiment.

Figure 21:
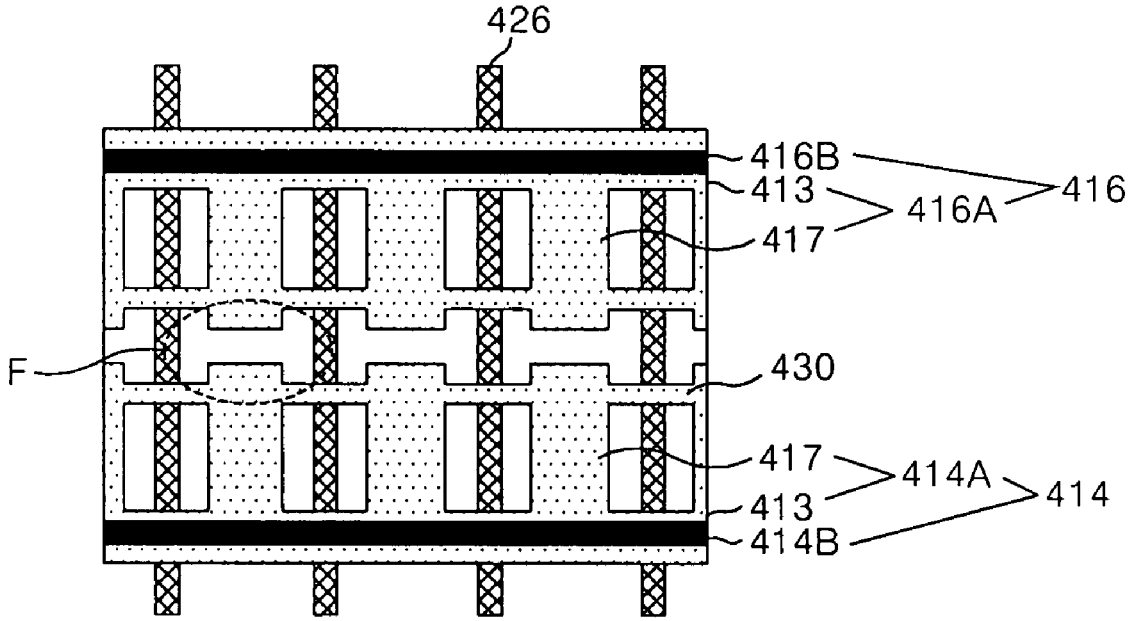
FIG. 21 is a plan view showing an electrode structure in a plasma display panel according to a thirteenth embodiment of the present invention.

Referring to FIG. 21, a PDP according to a thirteenth embodiment of the present invention is comprised of a sustain electrodes 414 and 416 having a relatively large width and respectively provided with transparent electrodes 414A and 416A, including a stripe part 413 formed from a transparent electrode material (i.e., ITO) to transmit a visible light and a head part 417 expanded from the stripe part 413 into the center of the discharge cell within the discharge cell. Metal electrodes 414B and 416B having a relatively small width are provided at the stripe part 413 to compensate for a high resistance component of the stripe part 413. Stripe-shaped barrier ribs 426 divide adjacent discharge cells, and a link 430 connects the head parts 417 of adjacent transparent electrodes 414A and 416A to each other.

The stripe part 413 of each transparent electrode 414A and 416A is provided in a direction crossing the barrier ribs 426, while the head part 417 is expanded from the stripe part 413 into the center of the discharge cell in such a manner or to be non-overlapping with the barrier ribs 426. Thus, the transparent electrode material (i.e., ITO) at a non-discharge area overlapping with the barrier ribs 426 in each transparent electrode 414A and 416A is removed to thereby reduce a current amount wasted at the sustain electrode pair 414 and 416.

Figure 22:
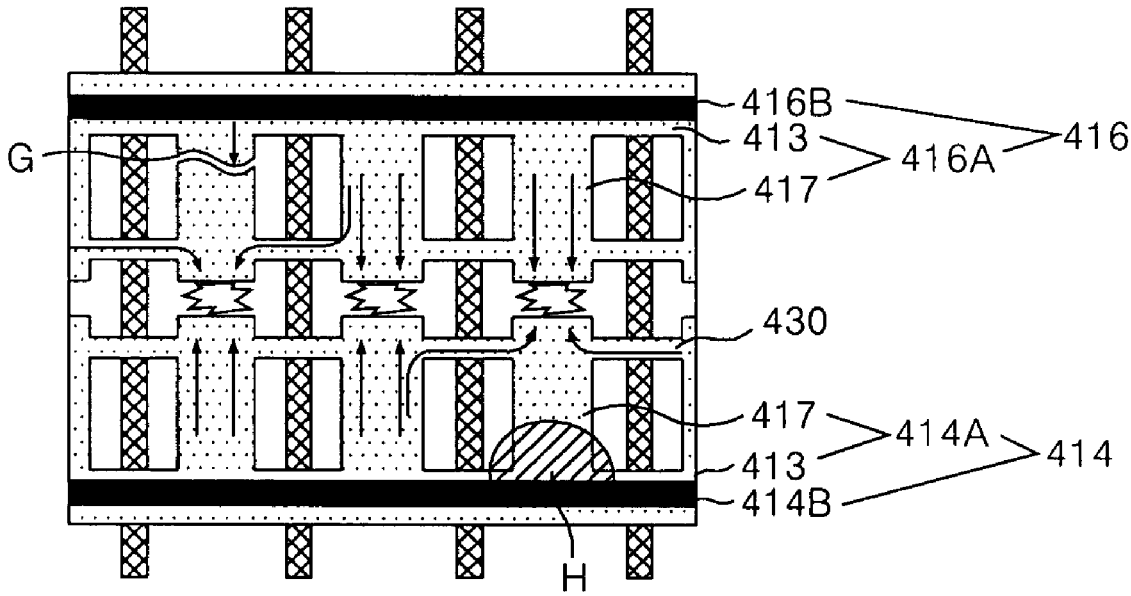
FIG. 22 is a plan view showing a discharge current path of the electrode structure in the plasma display panel according to the thirteenth embodiment of the present invention of FIG. 21.

The link 430 overlaps with barrier ribs 426, and is provided to lean, by approximately 10 μm to 200 μm, from the ends of the head parts 417 of adjacent of adjacent transparent electrodes 414A and 416A, thereby connecting the head parts 417 of the transparent electrodes 414A and 416A of adjacent discharge cells to each other. Such a link 430 forms a path of discharge current through the head parts 417 of adjacent transparent electrodes 414A and 416A, even though a breakage of a transparent electrode material (i.e., ITO) may occur upon formation of the transparent electrodes 414A and 416A. Thus, in the PDP according to the thirteenth embodiment, as shown in FIG. 22, a discharge current is applied, via link 430, from the head part 417 of each transparent electrode 414A and 416A of other discharge cell to the transparent electrodes 414A and 416A broken by a cell defect resulting from an alien substance G or an air bubble H, etc. in the course of fabrication of the PDP.

Figure 23:
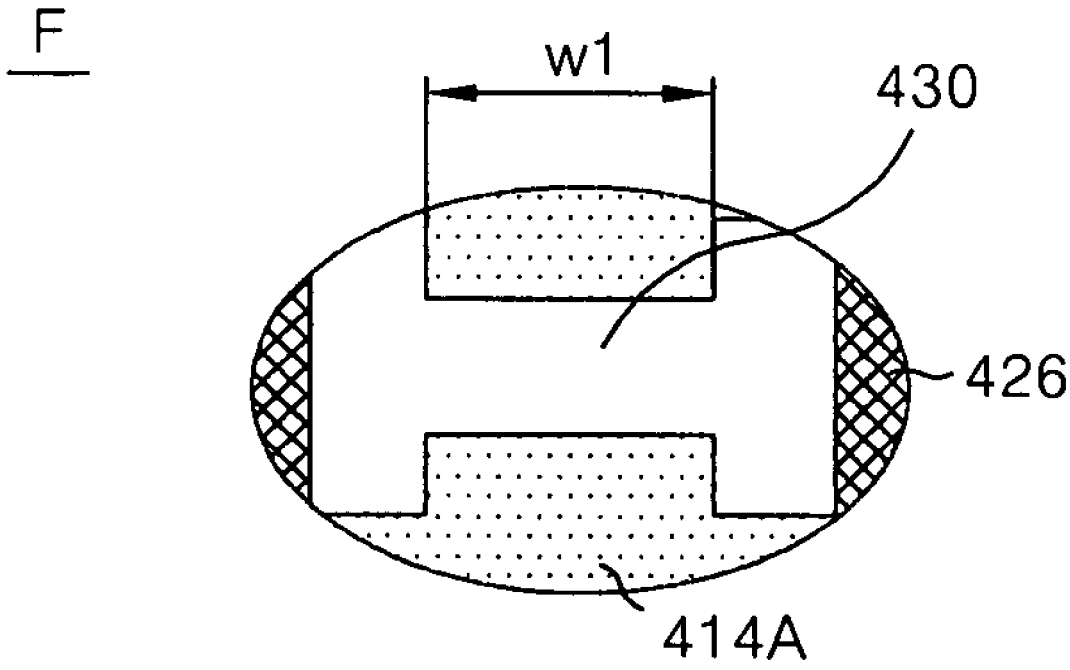
FIG. 23 is a plan view representing the F portion in FIG. 21.

The PDP according to the thirteenth embodiment thus connects the head parts 417 of the transparent electrodes 414A and 416A provided within adjacent discharge cells, via link 430, to each other, to thereby prevent non-discharge caused by a cell defect occurring in the course of the fabrication process. Furthermore, the PDP according to the thirteenth embodiment has a structure for preventing alignment deviation upon joining the upper substrate with the lower substrate with the aid of link 430. Moreover, in the PDP according to the thirteenth embodiment, as shown in FIG. 23, which is an expanded view of area F in FIG. 21, a length W1 of the opposite face of the head part 417 is reduced due to link 430 leaning into the inner side, by approximately 10 μm to 200 μm, at the end of the head part 417 of each transparent electrode 414A and 416A. As a result, black brightness is reduced and hence contrast ratio can be enhanced.

Furthermore, in the PDP according to the thirteenth embodiment of the present invention, a gap between the opposite head parts 417 within the discharge cell is different from that between adjacent discharge cells due to the link 430 leaning into a predetermined inner side from the end of the head part 417 of each transparent electrode 414A and 416A. As a result, discharge between adjacent discharge cells can be prevented and a cross talk can also be prevented. In addition, the PDP according to the thirteenth embodiment not only improves discharge efficiency and brightness, but also reduces power consumption like the PDP according to the first embodiment.

As described above, the PDP according to the embodiment of the present invention removes a portion of the transparent electrode having a small discharge distribution degree within the discharge cell to thereby reduce power consumption, and can smoothly supply a discharge current through the transparent electrode having the expanding part and the head part. Also, it provides the link for connecting adjacent transparent electrodes to each other, thereby preventing a miss-alignment upon joining of the substrates. Furthermore, it provides the barrier rib with the protrusion having the same incline plane as the expanding part of the transparent electrode, thereby improving the brightness and the discharge efficiency.

In addition, the PDP according to the embodiment of the present invention provides the link for connecting adjacent transparent electrodes to each other at the inner side spaced by a predetermined distance from the end of the transparent electrode, thereby reducing the black brightness and hence enhancing the contrast ratio. Also, it applies a discharge current from the transparent electrode of other discharge cell, via the link, to the broken transparent electrode even though there occurs a cell badness having the transparent electrode broken due to alien substances or air bubbles in the course of the fabrication process of the PDP, thereby preventing a non-discharge caused by the cell badness. Furthermore, it removes the transparent electrode material overlapping with the non-discharge area of the discharge cell and the barrier rib, thereby reducing a power wasted at the sustain electrode pair.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A plasma display panel, comprising:

a transparent electrode pair spaced with a predetermined gap therebetween within a discharge cell, at least one transparent electrode of said tranparent electrode pair including:

an expanding part having a width which enlarges towards a center of the discharge cell, and a head part connected to the expanding part and having at least a substantially constant width;

a barrier rib for dividing the discharge cell with an adjacent discharge cell;

a metal electrode formed in a first direction, and electrically coupled to the expanding part;

an address electrode provided in parallel to the barrier rib in a second direction different from the first direction such that the address electrode crosses the metal electrode; and a link overlapping the barrier rib for connecting to a transparent electrode of the adjacent discharge cell, wherein said link is formed at a predetermined depth extending from an end of the head part toward the expanding part, wherein said predetermined depth is approximately 10 μm to 200 μm.

2. The plasma display panel of claim 1, wherein said at least one transparent electrode further includes a strip part connected with the expanding part and connected to the metal electrode.

3. A plasma display panel, comprising:

a transparent electrode pair spaced with a predetermined gap therebetween within a discharge cell, at least one transparent electrode of said transparent electrode pair including:

an expanding part having a width which enlarges towards a center of the discharge cell, a head part connected to the expanding part and having at least a substantially constant width, and a stripe part positioned at the discharge cell and connected with the expanding part;

a metal electrode formed in a first direction, and electrically coupled to the expanding part;

a barrier rib for dividing the discharge cell with an adjacent cell;

an address electrode provided in parallel to the barrier rib in a second direction different from the first direction such that the address electrode crosses the metal electrode, wherein the expanding part includes:

a first side set to a range substantially equal to 50% to 150% of a width of the address electrode, a second side being opposite to the first side and having a larger width than the first side, and an inclined plane provided between the first side and the second side; and a link overlapping the barrier rib for connecting to a transparent electrode of said adjacent discharge cell, wherein said link is formed at a predetermined depth extending from an end of the head part toward the expanding part.

4. The plasma display panel as claimed in claim 3, wherein said predetermined depth is approximately 10 μm to 200 μm.

5. The plasma display panel of claim 3, wherein said barrier rib includes a protrusion from each side thereof into a center of the discharge cell, and said link leans into ends of the opposite head parts.

6. A plasma display panel, comprising:

a first transparent electrode having a first head part protruding from one side of a discharge cell into a center of the discharge cell, and a first strip part connected to the first head part; and a second transparent electrode which includes an expanding part having a larger width as it goes from the other side thereof within the discharge cell into the center of the discharge cell in such a manner to be spaced by a predetermined gap from the first transparent electrode within the discharge cell, and a second head part connected to the expanding part and having a substantially constant width, and a second strip part connected to the expanding part;

a first metal electrode connected to the first strip part and a second metal electrode connected to the second strip part, the first and second metal electrodes being formed in a first direction;

a barrier rib for dividing the discharge cell from an adjacent discharge cell;

an address electrode provided in a second direction different from the first direction such that the address electrode crosses the first and second metal electrodes;

a first link overlapping the barrier rib for connecting to a transparent electrode of the adjacent discharge cell, the first link being formed at a first predetermined depth extending from an end of the first part toward the first strip part; and a second link overlapping the barrier rib for connecting to another transparent electrode of the adjacent discharge cell, the second link being formed at a second predetermined depth extending from an end of the second head part toward the expanding part, wherein each of said first and second predetermined depths is approximately 10 μm to 200 μm.

7. A plasma display panel, comprising:

a sustain electrode pair including a transparent electrode pair spaced with a predetermined gap therebetween within a discharge cell, and a first metal electrode connected to one of the transparent electrode pair and a second metal electrode coupled to other one of the transparent electrode pair, the first and second metal electrodes being formed in a first direction, at least one transparent electrode of said transparent electrode pair including:

a neck part connected to the metal electrode, an expanding part connected to the neck part and having a width which enlarges as it goes into a center of the discharge cell, and a head part connected to the expanding part and having a substantially constant width;

a barrier rib for dividing the discharge cell from an adjacent discharge cell and formed in a first direction;

an address electrode provided in a second direction different from the first direction such that the address electrode crosses the first and second metal electrodes; and a link overlapping the barrier rib for connecting to a transparent electrode of said adjacent discharge cell, wherein the link is formed at a predetermined depth extending from an end of the head part toward the expanding part, wherein said predetermined depth is approximately 10 μm to 200 μm.

8. A plasma display panel, comprising:

a pair of transparent electrodes having a predetermined gap therebetween within a discharge cell, wherein at least one of said transparent electrodes includes:

a stripe part, a head part protruding from the stripe part into a center of the discharge cell, and a link overlapping a barrier for connecting to a transparent electrode of an adjacent cell;

a metal electrode connected to the stripe part and formed in a first direction; and an address electrode provided in a second direction crossing the metal electrode, wherein said link is formed at a predetermined depth extending from an end of the head part toward an expanding part, wherein said predetermined depth is approximately 10 μm to 200 μm.

* * * * *